US007796920B2

(12) United States Patent
Taguma et al.

(10) Patent No.: US 7,796,920 B2
(45) Date of Patent: Sep. 14, 2010

(54) DEVELOPING UNIT AND IMAGE FORMING APPARATUS INCLUDING THE SAME

(75) Inventors: Kenichi Taguma, Sagamihara (JP); Chiemi Kaneko, Setagaya-ku (JP); Hirokatsu Suzuki, Zama (JP); Emiko Shiraishi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 323 days.

(21) Appl. No.: 11/563,544

(22) Filed: Nov. 27, 2006

(65) Prior Publication Data

US 2007/0122202 A1 May 31, 2007

(30) Foreign Application Priority Data

Nov. 25, 2005 (JP) ..... 2005-339755
Sep. 29, 2006 (JP) ..... 2006-266514

(51) Int. Cl.
*G03G 15/08* (2006.01)

(52) U.S. Cl. ..... 399/254

(58) Field of Classification Search ..... 399/254, 399/255, 256, 258, 263, 219
See application file for complete search history.

(56) References Cited

U.S. PATENT DOCUMENTS 5,937,228 A 8/1999 Shoji et al.
5,950,056 A 9/1999 Hamamichi et al.
5,970,280 A 10/1999 Suzuki et al.
6,173,148 B1 1/2001 Matsuda et al.
6,347,214 B1 2/2002 Kaneko
6,366,751 B1 4/2002 Shakuto et al.
6,757,509 B2 6/2004 Shoji et al.
6,801,742 B1 10/2004 Mochimaru et al.
6,983,117 B2 1/2006 Sohmiya at al.
7,003,251 B2 2/2006 Suzuki et al.

(Continued)

FOREIGN PATENT DOCUMENTS

EP 1 505 455 A1 2/2005

(Continued)

OTHER PUBLICATIONS

U.S. Appl. No. 11/940,033, filed Nov. 14, 2007, Enoki, et al.

(Continued)

*Primary Examiner*—David M Gray
*Assistant Examiner*—Andrew V Do
(74) *Attorney, Agent, or Firm*—Oblon, Spivak, McClelland, Maier & Neustadt, L.L.P.

(57) ABSTRACT

A developing unit circulates a developer unidirectionally and includes a developer carrier having a magnetic field generator therein. The developing unit further includes a supply part housing a supply screw, a collecting part housing a collecting screw, an agitation part housing an agitation screw, a first opening, a second opening, and a third opening. The developer is transported by the supply screw, the collecting screw, and the agitation screw from the collecting screw to the agitation screw through the first opening, from the agitation screw to the supply screw through the second opening, and from the supply screw to the collecting screw though the third opening in a developer circulation. A height of a bottom surface of the downstream part of the agitation screw is higher than a height of a bottom surface of the supply screw.

19 Claims, 14 Drawing Sheets

U.S. PATENT DOCUMENTS

| | | | | |
|---|---|---|---|---|
| 7,039,349 | B2 | 5/2006 | Sohmiya et al. | |
| 7,054,587 | B2 | 5/2006 | Sohmiya et al. | |
| 7,082,282 | B2 | 7/2006 | Kaneko | |
| 7,085,514 | B2 | 8/2006 | Kaneko | |
| 2004/0131398 | A1 | 7/2004 | Omata et al. | |
| 2004/0229152 | A1* | 11/2004 | Kurosu | 430/122 |
| 2004/0247342 | A1* | 12/2004 | Selinger et al. | 399/254 |
| 2005/0025538 | A1* | 2/2005 | Omata | 399/329 |
| 2005/0152707 | A1 | 7/2005 | Suzuki et al. | |
| 2005/0232666 | A1* | 10/2005 | Ojimi et al. | 399/346 |
| 2005/0254846 | A1 | 11/2005 | Yura et al. | |
| 2005/0275896 | A1 | 12/2005 | Taguma | |
| 2006/0024095 | A1 | 2/2006 | Suzuki et al. | |
| 2006/0029431 | A1* | 2/2006 | Tanaka et al. | 399/254 |

FOREIGN PATENT DOCUMENTS

| | | | |
|---|---|---|---|
| JP | 06-051634 | | 2/1994 |
| JP | 11-167260 | | 6/1999 |
| JP | 2001183893 | A * | 7/2001 |
| JP | 2001-249545 | | 9/2001 |
| JP | 2001-290368 | | 10/2001 |
| JP | 2003-263025 | | 9/2003 |
| JP | 2003-263026 | | 9/2003 |
| JP | 2006-251440 | | 9/2006 |

OTHER PUBLICATIONS

U.S. Appl. No. 11/567,120, filed Dec. 5, 2006, Ishikawa, et al.
U.S. Appl. No. 12/049,838, filed Mar. 17, 2008, Senoh, et al.

* cited by examiner

DEVELOPING UNIT AND IMAGE FORMING APPARATUS INCLUDING THE SAME

BACKGROUND OF THE INVENTION

1. Field of the Invention

The present invention generally relates to a developing unit and an image forming apparatus including the same, and more particularly to a developing unit and an image forming apparatus including the same capable of forming a toner image with a stable density.

2. Discussion of the Background

In general, an image forming apparatus employing an electrophotographic method, such as a copying machine, a printer, a facsimile machine, etc. forms an electrostatic latent image on an image carrier. Such an electrostatic latent image is developed into a toner image by a developing unit. The toner image is thermally fixed with a fixing unit and transferred onto a sheet.

In developing units, a two-component developer including a toner and a carrier is widely used. The toner is charged by friction between the carrier and toner, and adheres to the electrostatic latent image due to electrostatic effects. The developer used in a developing process is collected. As toner density in the used developer is decreased, unused toner is added. The unused toner is mixed with the used developer and supplied to an electrostatic latent image through a developing roller.

It is necessary to maintain a certain level of toner density and charge quantity in the developer for a stable toner image. Toner density is determined by toner consumption in the developing process and distribution of supplied toner. The charge quantity of toner is determined by frictional charging during mixing of the carrier and the toner. It is necessary to adequately agitate such a two-component developer.

A related-art developing unit employs a biaxial conveyance method (biaxial developing unit) and includes a developing roller, a transport screw, and an agitation screw. The two screws are horizontally provided side by side beneath the developer carrier. The transfer screw supplies a developer to the developing roller and collects a used developer from the developing roller. The agitation screw transports the developer in a direction opposite to a flow direction of the developer transported by the supplying and collecting screw.

Another related-art developing unit employs a unidirectional circulation method. A developing unit 101 includes a developing roller 102, a supply passage 103, a collecting passage 104, and an agitating passage 105 provided in parallel with each other as illustrated in FIG. 1. The collecting passage 104 and agitating passage 105 are arranged side by side below the developing roller 102, and the supply passage 103 is arranged above the agitating passage 105. Each of the supply passage 103, collecting passage 104, and agitating passage 105 includes a screw (103*a*, 104*a*, and 105*a* respectively) to transport and/or agitate the developer. Although walls separate the three parts, openings are provided on the walls so that the developer may be unidirectionally circulated in the developing unit 101.

In another related-art unidirectional circulation developing unit, quantities of developer transported by a developer carrier, a collecting screw, an agitation screw, and/or a transporting screw are predetermined to smooth a circulation of developer and to equalize toner density. The collecting screw is capable of transporting more developer than a developer transported by the developer carrier, and the agitation screw or transporting screw is capable of transporting more developer than a quantity transported by the collecting screw.

Toner density may be more stabilized in the unidirectional circulation method than in the biaxial conveyance method. However, the developer may be stressed during exchange between screws, especially when the developer is lifted from a collecting or agitation part located below a developing roller to a supply part located above the developing unit. Further, the charge quantity of the developer may be decreased due to time degradation.

SUMMARY OF THE INVENTION

In view of foregoing, in one example, a developing unit circulates a developer unidirectionally and includes a developer carrier having a magnetic field generator therein. The developing unit further includes a supply part housing a supply screw, a collecting part housing a collecting screw, an agitation part housing an agitation screw, a first opening, a second opening, and a third opening. The developer is transported by the supply screw, the collecting screw, and the agitation screw from the collecting screw to the agitation screw through the first opening, from the agitation screw to the supply screw through the second opening, from the supply screw to the collecting screw though the third opening in a developer circulation. A height of a bottom surface of the downstream part of the agitation screw is higher than a height of a bottom surface of the supply screw and/or a height of a bottom surface of the collecting screw is higher than the height of the bottom surface of the upstream part of the agitation screw.

In another example, a novel developing unit circulates a developer unidirectionally and includes a developer carrier having a magnetic field generator therein. The developing unit further includes a supply part housing a supply screw, a collecting part housing a collecting screw, an agitation part housing an agitation screw, a transport part housing a transport screw, a first opening, a second opening, a third opening, and a fourth opening. The developer is transported by the supply screw, the collecting screw, the agitation screw, and the transport screw from the collecting screw to the agitation screw through the first opening, from the agitation screw to the transport screw through a second opening, from the transport screw to the supply screw though the third opening, from the supply screw to the collecting screw though the fourth opening. A height of bottom surface of the downstream part of the agitation screw is higher than a height of a bottom surface of the transport screw and/or a height of a bottom surface of the collecting screw is higher than a height of a bottom surface of the upstream part of the agitation screw.

In another example, a novel color image forming apparatus includes an image carrier and a plurality of developing units.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
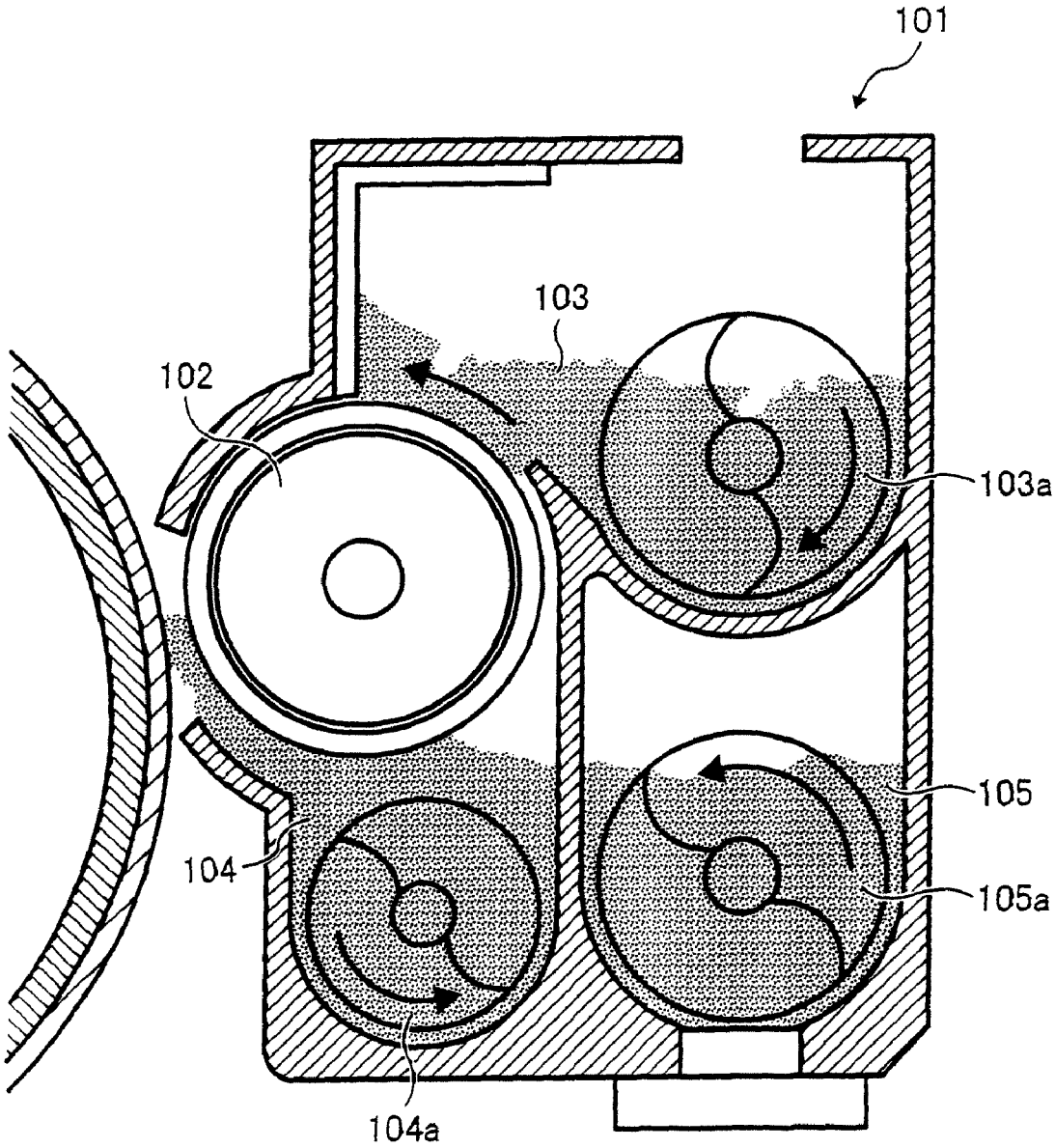
FIG. 1 RELATED ART
FIG. 1 is a cross-section diagram illustrating a related-art developing unit.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
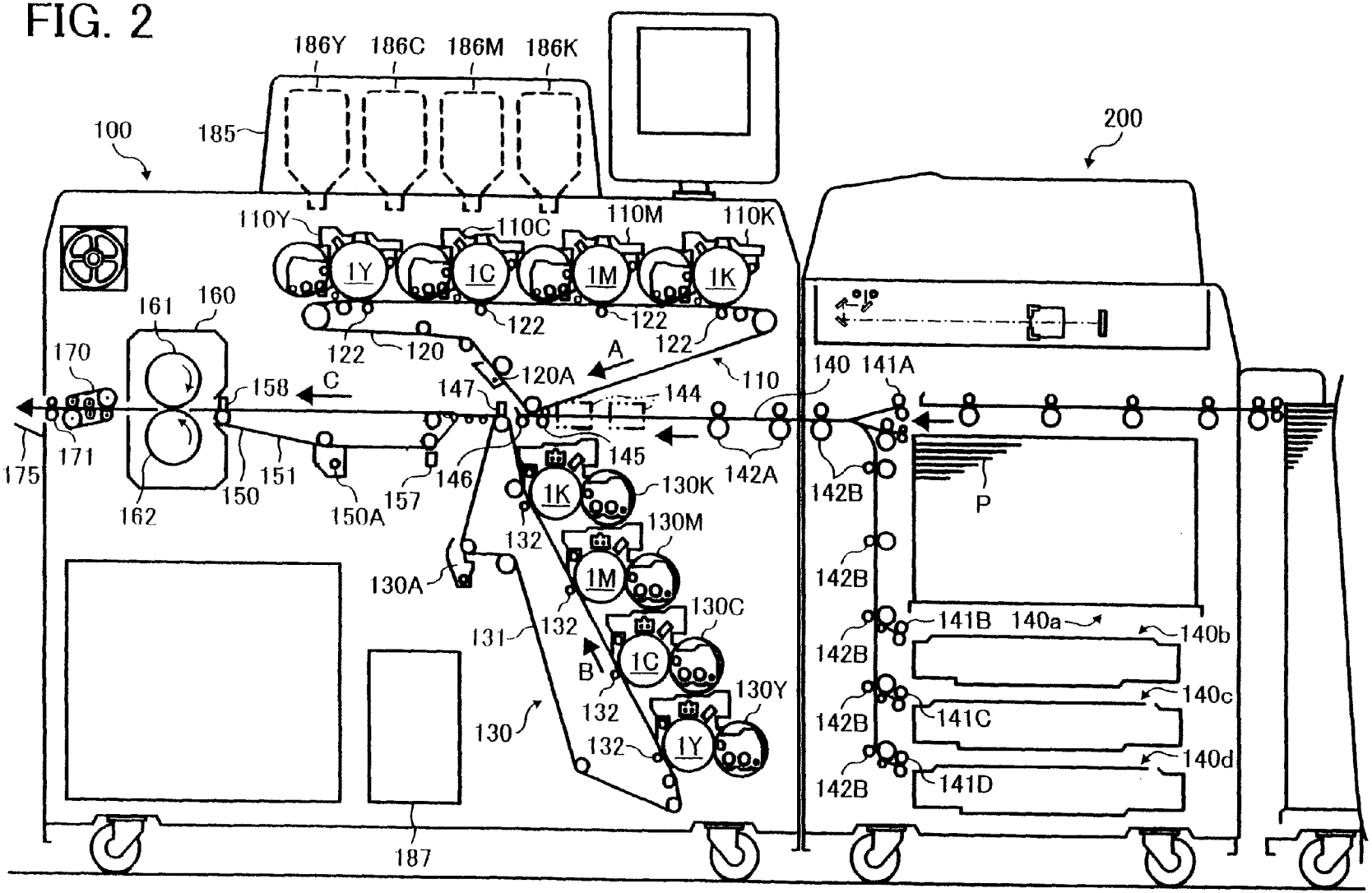
FIG. 2 is an illustration of an image forming apparatus according to an exemplary embodiment of the present invention.

Referring now to the drawings, wherein like reference numerals designate identical or corresponding parts throughout the several views, particularly to FIG. 2, an image forming apparatus 100 according to an exemplary embodiment of the present invention is described.

FIG. 2 illustrates the image forming apparatus 100 and a sheet feeding unit 200. The image forming apparatus 100 includes a first image carrying unit 110, a second image carrying unit 130, and a transport passage 140. The first image carrying unit 110 is provided above the transport passage 140. The second image carrying unit 130 is provided beneath the transport passage 140. Along the sheet transport passage 140, a plurality pairs of transport rollers 142A, a jogger 144, a pair of registration rollers 145, a secondary transfer roller 146, a transfer charger 147, a sheet conveyor 150, a fixing unit 160, a pair of cooling rollers 170, a pair of discharge rollers 171, and a stacker 175 are provided in the image forming apparatus 100. Further, the image forming apparatus 100 includes a cartridge container 185 and a collecting part 187.

The first image carrying unit 110 includes first image forming units 110Y, 110C, 110M, and 110K, a first image carrying belt 120, four primary transfer rollers 122, and a cleaning device 120A. The second image carrying unit 130 includes second image forming units 130Y, 130C, 130M, and 130K, a second image carrying belt 131, and a cleaning device 130A. The sheet conveyer 150 includes a cleaning device 150A, a conveyance belt 151, a charger 157, and a separation charger 158. The fixing unit 160 includes a fixing roller 161 and a pressing roller 162. The letters Y, C, M, and K represent yellow, cyan, magenta, and black, respectively. Each of the image forming units 110Y, 110C, 110M, and 110K forms a different color image of yellow, cyan, magenta, or black.

The first image carrying belt 120 is stretched around a plurality of rollers. The first image forming units 110Y, 110C, 110M, and 110K are arranged on an upper surface (outer surface) of the first image carrying belt 120. The first image forming units 110Y, 110C, 110M, and 110K include photoconductors 1Y, 1C, 1M, and 1K, respectively. Each of the primary transfer rollers 122 is provided on an inner surface of the first image carrying belt 120 and faces one of the first image forming units 110Y, 110C, 110M, or 110K across the first image carrying belt 120. The cleaning device 120A is provided on an outer surface of the first image carrying belt 120.

The first image carrying unit 110 integrally includes the above components related to the first image carrying belt 120 as a first image station configured to be attachable to, and detachable from, the image forming apparatus 100.

Likewise, the second image carrying unit 130 is an integrated second image station configured to be attachable to, and detachable from, the image forming apparatus 100. The second image carrying belt 131 is stretched around a plurality of rollers. The second image forming units 130Y, 130C, 130M, and 130K are arranged on an inclined surface (outer surface) of the first image carrying belt 131. The second image forming units 130Y, 130C, 130M, and 130K include photoconductors 1Y, 1C, 1M, and 1K, respectively. The image forming units 110Y, 110C, 110M, and 110K form different color images. Each of the primary transfer rollers 132 is provided on an inner surface of the second image carrying belt 131 and faces one of the second image forming units 130Y, 130C, 130M, or 130K across the second image carrying belt 131. The cleaning device 130A is provided on an outer surface of the second image carrying belt 131.

The first image carrying unit 110 and the second image carrying unit 130 form electrostatic latent images, develop the electrostatic latent images into toner images, and transfer the toner images on a recording sheet, which is described further in detail later. The toner image formed by the first image carrying unit 110 is transferred on a first side (front side) of a recording sheet, and the toner image formed by the second image forming unit 130 is transferred on a second side (back side) of the recording sheet. The first image carrying belt 120 and the second image carrying belt 131 may be endless belts. The first image carrying belt 120 and the second image carrying belt 131 are configured to be in contact with a part of each of the photoconductors 1Y, 1C, 1M, and 1K after a developing process. The photoconductors 1Y, 1C, 1M, and 1K are image carriers and may be arranged at constant intervals on the first image carrying belt 120 and the second image carrying belt 131, respectively.

The first image carrying belt 120 carries the toner image and travels in a direction shown by arrow A. The cleaning device 120A removes a remaining toner and a foreign material, for example, a paper dust, from the first image carrying belt 120. The second image carrying belt 131 may travel in a direction shown by arrow B. The cleaning device 130A removes a remaining toner and a foreign material from the second image carrying belt 131. The removed toner and foreign materials are sent to the collecting part 187.

The sheet transport passage 140 runs across the image forming apparatus 100 from the sheet feeding unit 200 to the sheet stacker 175 (direction shown by arrow C). The pairs of transport rollers 142A forward a sheet P from the sheet feeding unit 200. The jogger 144 jogs the sheet P from perpendicular sides, in a direction shown by arrow C, along the surface of the sheet P to align the sheet P. The pair of registration rollers 145 is provided between the jogger 144 and the secondary transfer roller 146 in the sheet transport passage 140. The pair of registration rollers 145 may sandwich a front edge of the sheet P in a nip therebetween and timely rotate so that the toner image carried on the first image carrying belt 120 may be transferred at a desired position on the sheet P.

The secondary transfer roller 146 is a first secondary transfer member and provided on the outer surface of the first image carrying belt 120. When the sheet P passes between the first image carrying belt 120 and the secondary transfer roller 146 (first transfer station), the secondary transfer roller 146 is biased, and the toner image carried by the first image carrying belt 120 is transferred onto the sheet P.

The secondary transfer charger 147 is a second secondary transfer member and provided on the outer surface of the second image carrying belt 131. The secondary transfer charger 147 is a device commonly known to those who are skilled in the art. The secondary transfer charger 147 uses a wire, for example, tungsten or gold wire, as a discharge electrode supported by a casing. When the sheet P passes between the second image carrying belt 131 and the secondary transfer charger 147 (second transfer station), a power source (not shown) charges the discharge electrode with transfer current and the toner image carried by the second image carrying belt 131 is transferred onto the sheet P. The secondary transfer roller 146 and secondary transfer charger 147 are charged with anode current having a polarity opposite to a polarity of the toner.

The sheet conveyer 150 may horizontally transport the sheet P passed the secondary transfer charger 147 to the fixing unit 160. The conveyance belt 151 may be an endless belt and supported by a plurality of rollers. The conveyance belt 151 may travel in the direction shown by arrow C while being in contact with the unfixed toner. Resistance of a surface of the conveyance belt 151 may be low enough to be negatively charged by the charger 157. The conveyance belt 151 is negatively charged and has a same polarity as the polarity of the toner (negative), which prevents the unfixed toner from adhering on the surface of the conveyance belt 151. The conveyance belt 151 may be a metal belt, a polyimide belt, a polyamide belt, or the like. The conveyance belt 151 travels at a speed harmonized with a transport speed of the sheet P. The cleaning device 150A provided on an outer surface of the conveyance belt 151 cleans the conveyance belt 151. The separation charger 158 is charged with alternating current (AC) to separate the sheet P from the conveyance belt 151.

The fixing unit 160 is provided downstream of the sheet conveyer 150 and includes a heater (not shown). The heater may be provided inside the fixing roller 161. While the sheet P is sandwiched between the fixing roller 161 and the pressing roller 162, the toner image is fixed on the sheet P with heat and pressure. Alternatively, the fixing unit 160 may further include a fixing belt that is heated by the heater, or may employ an induction heating method. To equalize quality (e.g. color saturation and gloss) of toner images formed on both sides of the sheet P, the fixing roller 161 or the fixing belt and the pressing roller 162 are configured to have a similar material, hardness, surface characteristics, and the like. The fixing unit 160 may be controlled by a controller (not shown) so that an optimum fixing condition may be set according to an image forming setting, for example, full color or monochrome setting, simplex or duplex setting, and/or a type of a recording sheet.

The pair of cooling rollers 170 is located downstream of the fixing unit 160 in the sheet transport passage 140 and cools the sheet P to stabilize an unstable toner image soon after the fixing process. The pair of cooling rollers 170 may have a heat pipe configuration including a heat releasing part.

The cooled sheet P is sent to the stacker 175 located at a left of the image forming apparatus 100 by the pair of discharge rollers 171 and stacked therein. The stacker 175 may include a receiving part and an elevating mechanism (not shown) so that the receiving part is moved up and down according to a quantity of stacked sheets, and a large quantity of sheets may be stacked in the stacker 175. The image forming apparatus 100 may further include a finisher (not shown) to perform a book bonding function including punching, cutting, holding, and/or stapling. The sheet P may be sent to the finisher from the stacker 175.

The cartridge container 185 detachably includes toner cartridges 186Y, 186C, 186M, and 186K. Each of the toner cartridges 186Y, 186C, 186M, and 186K contains unused developer including a carrier and a toner. In an exemplary embodiment, the common toner cartridges 186Y, 186C, 186M, and 186K supply the developer to the first image carrying unit 110 and the second image carrying unit 130 via a developer transport member (not shown) as required. Alternatively, separate toner cartridges may supply the developer to the first image carrying unit 110 and the second image carrying unit 130. The size of toner cartridge 186K may be larger than the size of toner cartridge 186Y, 186C, or 186M because consumption of a black toner is typically greater than the consumption of the other toners. As the cartridge container 185 is located in a back part of an upper surface of the image forming apparatus 100 when an operator operates the image forming apparatus 100, a front part of the upper surface of the image forming apparatus 100, which is flat, may be used as a working table.

Next, the sheet feeding unit 200 is described. The sheet feeding unit 200 located at a right of the image forming apparatus 100 includes a sheet tray 140A, cassettes 140B, 140C, and 140D, separators 141A, 141B, 141C, and 141D, and a plurality pairs of transport rollers 142B. Recording sheets P contained in the sheet tray 140A or cassettes 140B, 140C, or 140D are supplied to the image forming apparatus 100 by the transport rollers 142B. Each of the separators 141A, 141B, 141C, and 141D sends each sheet P one by one from sheet tray 140A or cassettes 140B, 140C, or 140D.

Figure 3:
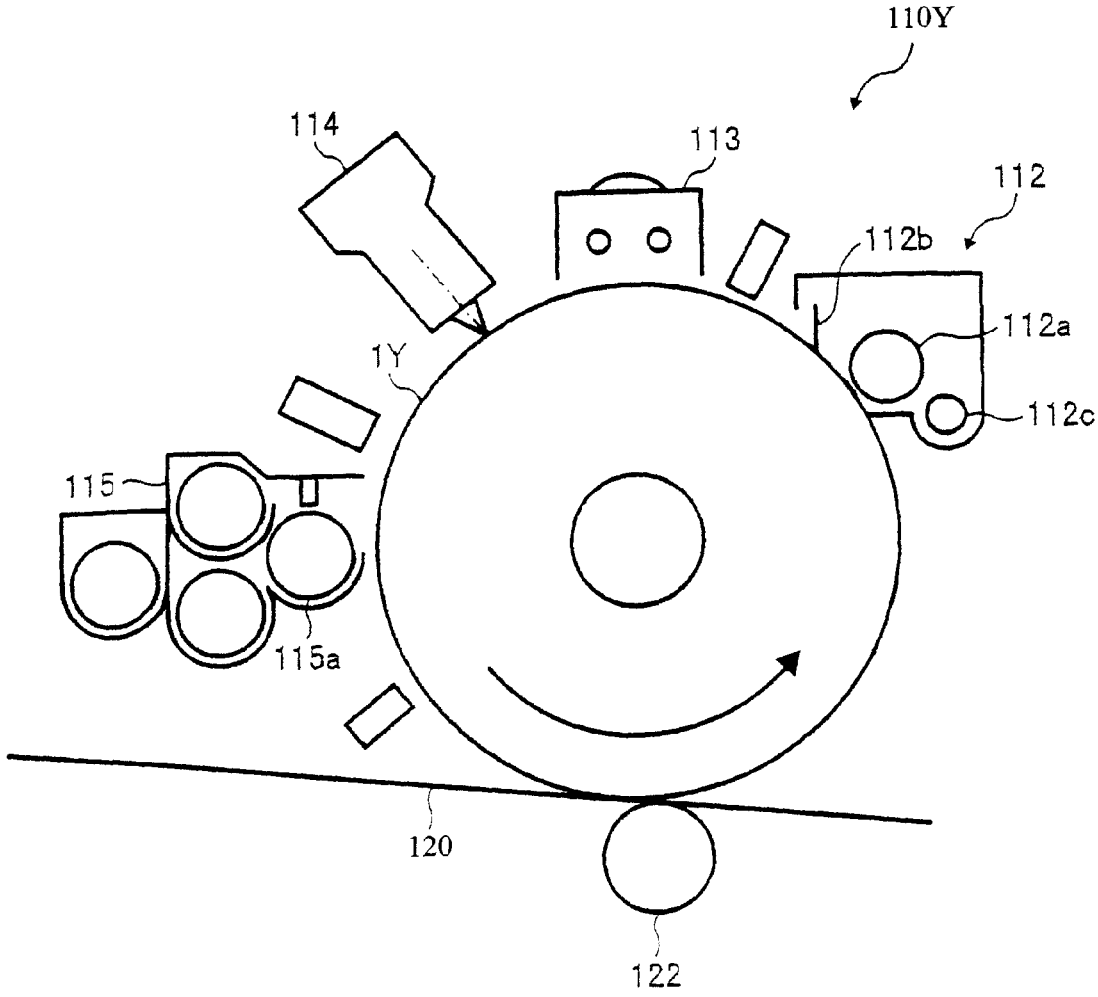
FIG. 3 is an illustration of an image forming unit included in the image forming apparatus of FIG. 2

Next, image forming unit 110Y is described in detail with reference to FIG. 3. The image forming unit 110Y further includes a cleaning unit 112, a scorotron charger 113, an exposure unit 114, and a developing unit 115 around the photoconductor 1Y. The cleaning unit 112 includes a brush 112*a*, a blade 112*b*, and a collecting member 112*c*. The developing unit 115 includes a developing roller 115*a* as a developer carrier.

The photoconductor 1Y may be produced by forming an organic photoreceptive (OPC) layer as a photoconductive substance on an aluminum cylinder that is from 30 mm to 120 mm in diameter. Alternatively, an amorphous silicon (a-Si) layer may be used instead of an OPC layer or the photoconductor 1Y may have a belt-like shape. The scorotron charger 113 uniformly charges a surface of the photoconductor 1Y.

Instead of the scorotron charger 113, the photoconductor 1Y may be charged by a charging member that directly touches the surface of the photoconductor 1Y, for example, a charging roller.

The exposure unit 114 emits light on the surface the photoconductor 1Y to form an electrostatic latent image for a yellow image thereon. The exposure unit 114 may include an array of light-emitting diode (LED) and an imaging element. Alternatively, the exposure unit 114 may include a laser source, a polygon mirror, and the like to irradiate the surface of the photoconductor 1Y with a beam modulated according to image data in a laser scanning method.

The developing unit 115 uses a two-component developer. The developing roller 115*a* visualizes the electrostatic latent image for yellow image with a yellow toner. The yellow toner has a same polarity (negative) as a polarity of the photoconductor 1Y. The developing unit 115 may employ a reversal development method in which a toner adheres to a portion where surface potential is decreased by light irradiation.

The cleaning unit 112 removes and collects foreign materials including a remaining toner on the photoconductor 1Y.

Each of the image forming units 110C, 110M, 110K, 130Y, 130C, 130M, and 130K has a similar configuration to the configuration of the image forming unit 110Y.

Next, a single sided printing using the image forming apparatus 100 are described with reference to FIG. 2. The image forming apparatus 100 selectably provides two basic methods to perform single sided printing. In a first example, a full color image formed on the first image carrying belt 120 is directly transferred onto a front side of the sheet P. In a second example, a full color image formed on the second image carrying belt 131 is directly transferred onto a back side of the sheet P. The order of image formation may be controlled so that the sheets P are sequentially stacked in the stacker 175 when a plurality of pages is output.

In the first example, the image forming apparatus 100 may sequentially record data from an image to be formed on a last page. When the image forming apparatus 100 is started, the first image carrying belt 120 and the photoconductors 1Y, 1C, 1M, and 1K in the first image carrying unit 110 starts to rotate. Although the second image carrying belt 131 simultaneously starts to rotate, the photoconductors 1Y, 1C, 1M, and 1K in the second image carrying unit 130 are disengaged from the second image carrying belt 131 and do not rotate.

Firstly, the first image forming unit 110Y may start image formation. The first image forming units 110C, 110M, 110Y, and 110K sequentially start image formation. The scorotron charger 113 uniformly charges the surface of the photoconductor 1Y. The LED of the exposure unit 114 irradiates the surface the photoconductor 1Y with light and forms an electrostatic latent image thereon. The electrostatic latent image is developed into a yellow toner image with the developing roller 115*a*. The corresponding primary transfer roller 122 electrostatically transfers the yellow image on the first image carrying belt 120. Sequentially, cyan, magenta, and black images are superimposed on the yellow image to form a full color image. The first image carrying belt 120 on which the full color image is formed moves in the direction shown by arrow A.

In the sheet feeding unit 200, the separator 141A, 141B, 141C, or 141D separates a sheet P from the sheets P contained in the sheet tray 140A or the cassette 140B, 140C, or 140D. The sheet P is transported to the transport passage 140 by the transport rollers 142B. The jogger 144 jogs and aligns the sheet P before the pair of registration rollers 145 sandwiches a front edge of the sheet P therebetween. The pair of registration rollers 145 is firstly motionless and stops the sheet P by sandwiching the front edge of the sheet P. The pair of registration rollers 145 timely rotates to send the sheet P so that the secondary transfer roller 146 may transfer the full color image from the first image carrying belt 120 to a desired poison on the front side of the sheet P. After the transferring process, cleaning device 120A cleans the surface of the first image carrying belt 120. The surface of photoconductors 1Y, 1C, 1M, and 1K are cleaned and discharged.

Next, the sheet P is transported to the fixing unit 160 by the conveyance belt 151 whose surface is negatively charged by the charger 157. The sheet P is disengaged from the conveyance belt 151 by the separation charger 158, and is sent to the fixing unit 160. The fixing unit 160 mixes and fuses the superimposed toners on the sheet P with heat. The single sided printing, which forms toner images on one side (front side) of the sheet P, requires less heat energy than the heat energy required for double sided printing in which toners are on both sides of the sheet P. The image forming apparatus 100 further includes a controller (not shown) to optimally control an amount of electricity used by the fixing unit 160 according to an image to be fixed. Before being completely fixed on the sheet P, the full color image may be damaged by being touched by a guide member or the like in the transport passage 140. The pair of cooling rollers 170 may cool the sheet P to prevent such damage.

The cooled sheet P is stacked in the stacker 175 by the pair of discharge rollers 171 so that the side having the full color image (front side) faces up. The order of image formation may be programmed to sequentially stack the sheets P so that a first page appears on top. The sheets P may be tidily stacked as the stacker 175 descends as an amount of the sheets P stacked thereon increases.

In the second example, the first image forming units 110Y, 110C, 110M, 110K do not perform image formation, and the second image forming units 130Y, 130C, 130M, and 130K forms images sequentially from the image to be appeared on a first page. In other respects, an image is formed on a sheet P through similar processes performed in the first example.

Next, a double sided printing process using the image forming apparatus 100 is described as a third example. When the image forming apparatus 100 is started, yellow, cyan, magenta, and black images are sequentially formed by the first image forming units 110Y, 110C, 110M, and 110K. The yellow, cyan, magenta, and black images are superimposed on top of each other as a first image on the first image carrying belt 120 by the primary transfer rollers 122, as described in the first example. In a process that is substantially parallel with the processes in the first image carrying unit 110, the second image carrying unit 130 similarly forms a second image on the second image carrying belt 131.

The first and second transfer stations are not at a same position in the transport passage 140 as illustrated in FIG. 2. Therefore, the second image carrying unit 130 starts to form the second image after the first image carrying unit 110 starts to form the first image to match positions of the first and second images transferred on both sides of the sheet P. The sheet P is timely forwarded by the pairs of transport rollers 142A and aligned by the jogger 144, considering that the sheet P is stopped at the pair of registration rollers 145 before transported to the position where the first and second images are transferred. The pair of registration rollers 145 timely sends the sheet P to the first transfer station where the secondary transfer roller 146 is positively charged and the first image on the first image carrying belt 120 is transferred onto the front side of the sheet P.

Next, the sheet P is sent by the secondary transfer roller 146 to the second transfer station where the secondary transfer charger 147 is positively charged and the second image on the second image carrying belt 131 is transferred onto the back side of the sheet P.

The sheet P is further sent toward the fixing unit 160 by the conveyance belt 151 whose surface is negatively charged by the charger 157 to prevent adhesion of unfixed toner. The separation charger 158 is charged with AC current to disengage the sheet P from the conveyance belt 151. The fixing unit 160 fixes the first and second images on both sides of the sheet P. The sheet P is cooled by the pair of cooling rollers 170, and stacked by the discharge roller 171 in the stacker 175.

The order of image formation may be controlled so that the first page of sheets P facing down is stacked bottommost in the stacker 175 if a plurality of pages are output on both sides of sheets P. In this case, the first page is on top of a first sheet P, a second page is on the back of the first page, a third page is on a front side of a second sheet P, and a fourth page is on a back of the third page when the sheets P are ejected from the stacker 175 and turned upside down. Controls, including order of image formation and power supplied to the fixing unit 160, may be executed by a controller (not shown).

Although above examples are explained as color printing, black and white images may be recorded in single sided printing and double sided printing.

Figure 4A:
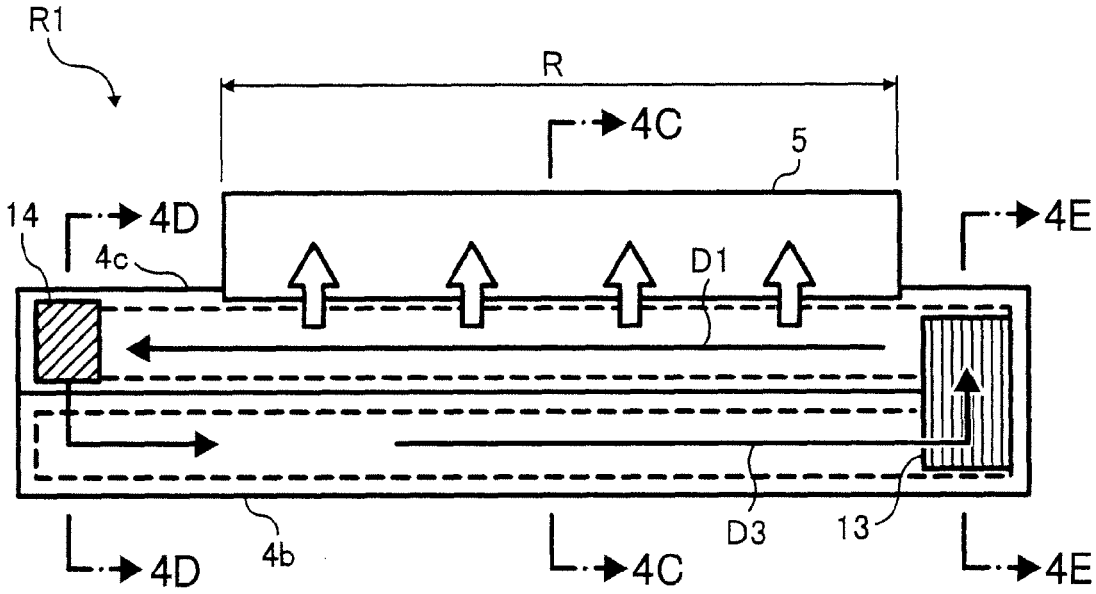
FIGS. 4A and 4B are schematic diagrams illustrating horizontal cross sections of a triaxial developing unit according to an exemplary embodiment of the present invention.
Figure 4B:
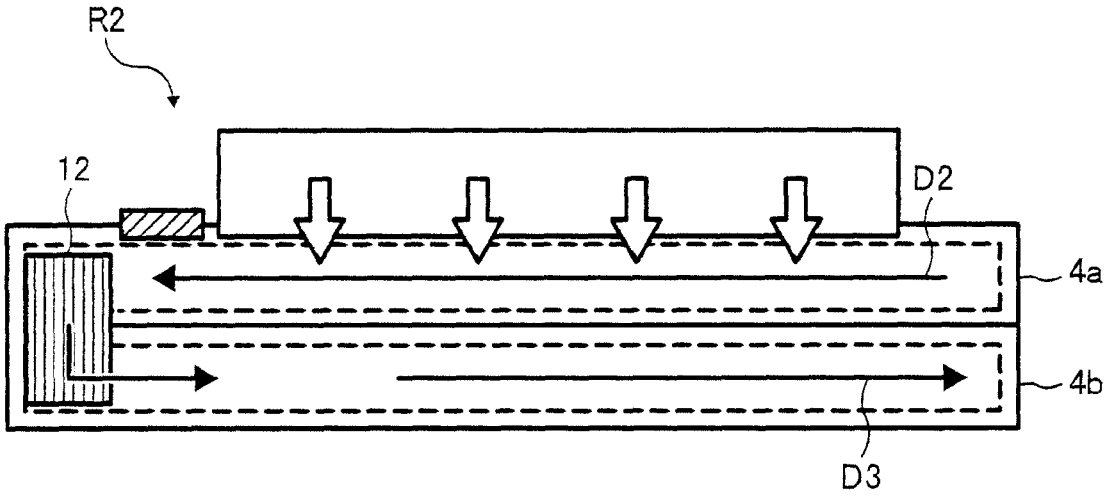
Figure 4C:
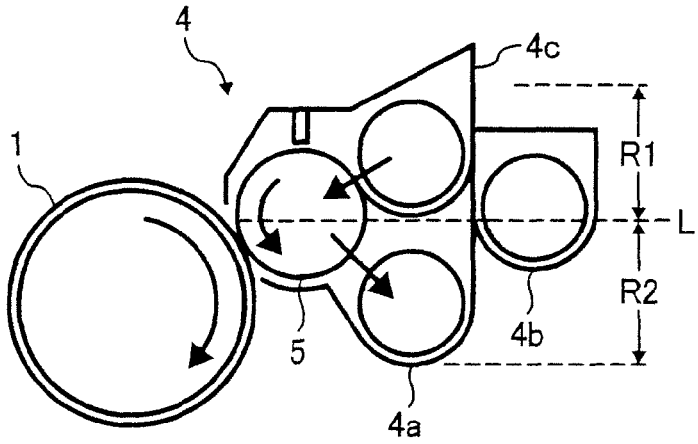
FIGS. 4C, 4D and 4E are schematic diagrams illustrating vertical cross-sections of the triaxial developing unit shown in FIG. 4A.
Figure 4D:
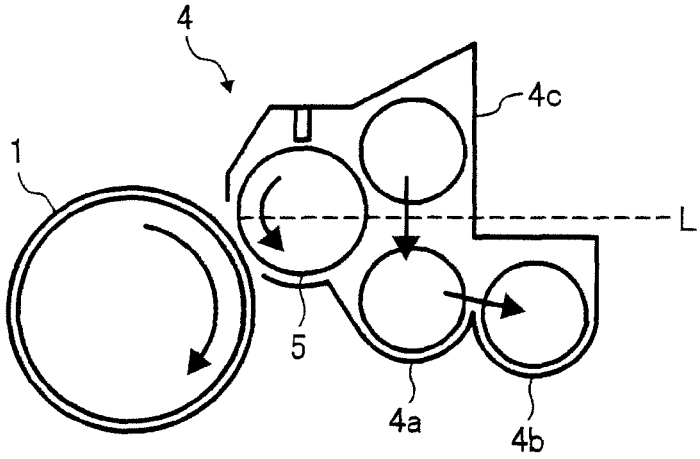
Figure 4E:
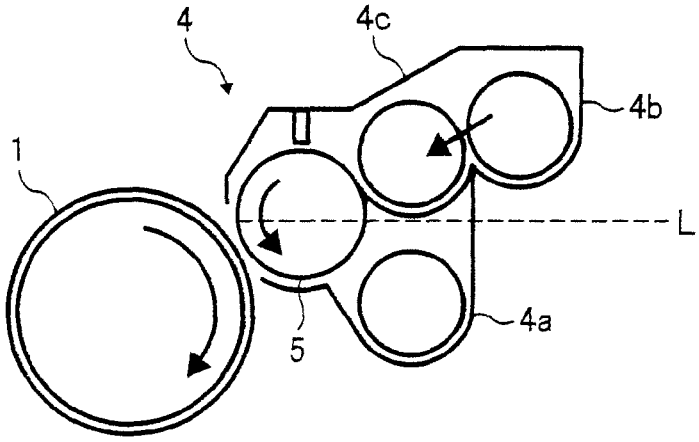

Next, a developing unit 4 according to an embodiment and circulation of a developer therein are described with reference to FIGS. 4A, 4B, 4C, 4D, and 4E. The developing unit 4 is divided into a first part R1 and a second part R2 by line L for illustrative purposes. FIGS. 4A and 4B illustrate the first part R1 and the second part R2 viewed from above. FIGS. 4C, 4D, and 4E illustrate cross sections C-C, D-D, and E-E of the developing unit 4 and a photoconductor 1.

The developing unit 4 is a triaxial developing unit and includes a supply part 4*c*, a collecting part 4*a*, and an agitation part 4*b* at an opposite side of the photoconductor 1 relative to the developing roller 5. In FIG. 4A, the developing roller 5, the supply part 4*c*, and the agitation part 4*b* are illustrated. The developing roller 5 has an image forming region R (developing region). The developing unit 4 further includes a first opening 12, a second opening 13, and a third opening 14. The collecting part 4*a* contacts with an upstream part of the agitation part 4*b* and a downstream part of the agitation part 4*b* contacts with the supply part 4*c*. The developer is circulated in the developing unit 4.

In FIGS. 4C, 4D, and 4E, the collecting part 4*a* is located below the supply part 4*c* that is located superior to the developing roller 5. The agitation part 4*b* is located aslant at an opposite side of the developing roller 5 relative to the collecting part 4*a* and the supply part 4*c*. The position of the agitation part 4*b* is different in the FIGS. 4C, 4D, and 4E as the agitation part 4*b* is provided aslant.

The developer is transported along a rotation axis of the developing roller 5 in the direction shown by arrow D1 and supplied to the developing roller 5 in the supply part 4*c*. The developer supplied to the developing roller 5 (used developer) is collected in the collecting part 4*a*. The developer that is transported in the supply part 4*c* but is not supplied to the developing roller 5 (unused developer) drops to the collecting part 4*a* through the third opening 14 that connects a downstream part of the supply part 4*c* and a downstream part of the collecting part 4*a*. The unused developer and the used developer are transported in the direction shown by arrow D2 in the collecting part 4*a* and sent to the agitation part 4*b* through the first opening 12 that contacts a downstream part in the collecting part 4*a* and the upstream part of the agitation part 4*b*. In the agitation part 4*b*, the unused developer and used developer are mixed, agitated and transported in the direction shown by arrow D3 to the second opening 13 that contacts the downstream part of the agitation part 4*b* and an upstream part of the supply part 4*c*.

Figure 5A:
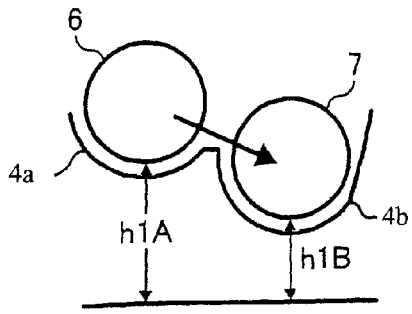
FIGS. 5A and 5B are illustrations to explain positional relations of a supply part, a collecting part, and an agitation part included in the triaxial developing unit of FIG. 4A

FIG. 5A illustrates that a height of a bottom surface of the collecting part 4*a* and a height of a bottom surface of the agitation part 4*b* (upstream part) at the first opening 12 has a relation:

$$h1A>h1B$$

where h1A is the height of the bottom surface of the collecting part 4*a* and h1B is the height of the bottom surface of the agitation part 4*b*.

Figure 5B:
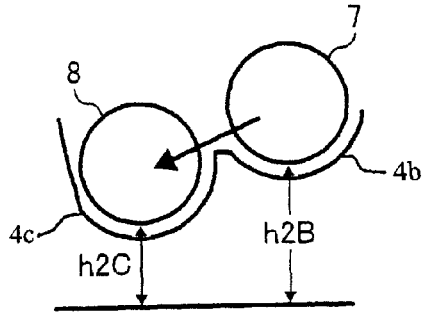

FIG. 5B illustrates that a height of a bottom surface of the agitation part 4*b* (downstream part) and a height of a bottom surface of the supply part 4*c* at the second opening 13 has a relation:

$$h2B>h2C$$

where h2B is the height of the bottom surface of the agitation part 4*b* and h2C is the height of the bottom surface of the supply part 4*c*.

The collecting part 4*a*, the agitation part 4*b*, and the supply part 4*c* have a difference in elevation at the first opening 12 and the second opening 13 which are exchange portions of the developer. The developer may flow down at the first opening 12 and the second opening 13, and the transport efficiency may be improved by a gravitational effect. Therefore, a stress that the developer may receive at the exchange portions may be reduced. Further, the transport efficiency may be improved in the entire developing unit 4 as all the exchange portions of the developer in the developing unit 4 have differences in elevation. The developer may be efficiently collected in the collecting part 4*a* by the gravitational effect as the collecting part 4*a* is located below the developing roller 5. Therefore, long time transport of the developer on the developing roller may be prevented. As a result, fluctuation in characteristics of the developer may be reduced and a life of the developer may be prolonged. The developing unit 4 may maintain a stable image density for a long time.

If the third opening 14, where the developer is sent from the supply part 4*c* to the collecting part 4*a*, is provided in the image forming region R, the developer may not be supplied to a portion of the developing roller 5 that is downstream of the third opening 14. Therefore, the third opening 14 may be provided out of the image forming region R (non-image forming region) so that the developer is supplied to the entire developing roller 5.

The triaxial developing unit 4 is described in detail with reference to FIG. 6. The developing roller 5 includes a magnet roller 5*a* and a cylinder shaped sleeve around the magnet roller 5*a*. The magnet roller 5*a* is a magnetic field generator and includes a plurality of magnets. The collecting part 4*a* includes a collecting screw 6, the agitation part 4*b* includes an agitation screw 7, and the supply part 4*c* includes a supply screw 8. The developing unit 4 further includes a developer regulator 16, a developer collector 18, a heat radiator 19, a capture roller 22, a scraper 23, a density sensor 27, and a fin 28. The heat radiator 19 includes a fin 20 and a guide 21.

The collecting screw 6, the supply screw 7, and the agitation screw 8 transport and/or agitate the developer. The size of the collecting screw 6, the supply screw 7, and the agitation screw 8 may be substantially same. Because the developer is transported upward in agitation part 4*b*, that is provided at an angle, a screw, which has high transport power, is efficient. In an exemplary embodiment, double-threaded screws having an outer diameter of 30 mm and a pitch of 36 mm are used. However, the size of the screw is not limited to the above. The developer is conveyed in a same direction in the collecting part 4*a* and the supply part 4*c*.

The developer regulator 16 is attached to the heat radiator 19 that is provided outside of the supply part 4*c* and releases heat from the developer. The developer regulator 16 includes an upstream part 17 and may regulate the developer to a thin layer to be sent to the developing roller 5. As more developer is desirably supplied to the developing roller 5 than an amount of the developer regulated by the developer regulator 16, excessive developer may accumulate at the upstream part 17 of the developer regulator 16. When the excessive developer accumulates, circulation convection may occur. The developer collector 18 is configured to divert and to return the excessive developer to the supply part 4*c* to prevent the circulation convection when the amount of the excessive developer reaches a certain level. The position of the developer regulator 18 is determined so that the returned developer does not accumulate due to a magnetic effect of the developing roller 5.

Further, the developer collector 16 may convey heat from the developer to the heat radiator 19. The fin 20 inside the heat radiator 19 may release the heat by air flow to restrain temperature increase of the developer. The guide 21 is used when the heat radiator 19 is attached to or detached from the developing unit 4 or a main body of a photoconductor unit (not shown).

The capture roller 22 is provided downstream of the developing roller 5. The capture roller 22 may capture the developer adhering to the photoconductor 1 and/or dropped from the developing roller 5 and rotate in a direction opposite to the rotation direction of the developing roller 5 to return the developer to the developing roller 5. Alternatively, the developer is sent to the collecting part 4*a* by the scraper 23. The density sensor 27 provided downside of the agitation screw 7 may measure toner density. The density sensor 27 outputs the toner density as a signal to a developer supply system described below. The fin 28 is provided on a casing of the developing unit 5 and may restrain temperature increase of the entire developing unit 4 by cooling air that is sent from a front to a back of the developing unit 4.

Figure 7A:
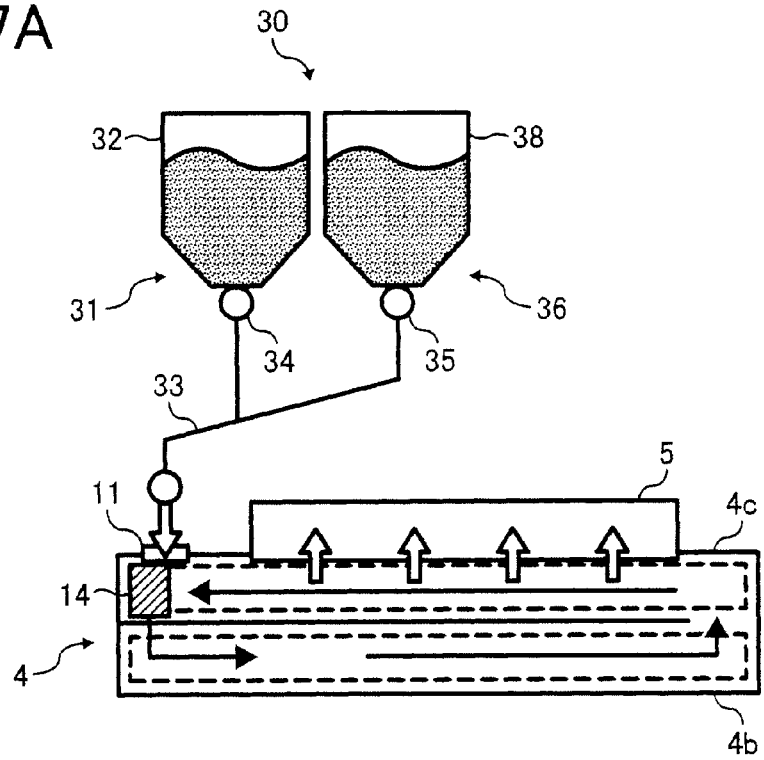
FIGS. 7A and 7B are illustrations to explain a developer supply unit that separately controls supplies of a toner and a carrier to the triaxial developing unit of FIG. 4A.
Figure 7B:
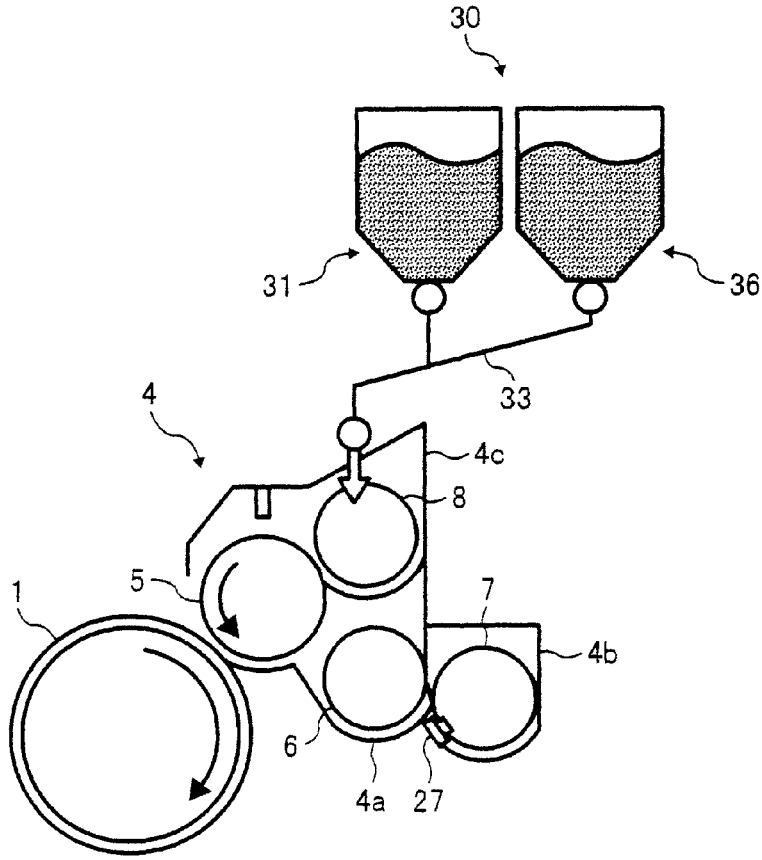

Next, supply of the developer to the developing unit 4 is described with reference to FIGS. 7A and 7B. The developing unit 4 further includes a supply port 11 and a developer supply unit 30. The supply port 11 may be provided above or near the third opening 14 in the supply part 4*c*. The developer supply unit 30 includes a toner supply device 31, a carrier supply device 36, and a developer supply passage 33. The toner supply device 31 includes a toner container 32 to store an unused toner and a toner supply part 34. The carrier supply device 36 includes a carrier container 38 to store an unused carrier and a carrier supply part 35.

The toner supply part 34 and the carrier supply part 35 control amounts of toner and carrier to be supplied, respectively according to the signal sent by the density sensor 27. Each of the toner supply part 34 and the carrier supply part 35 may be a rotational member on which a hole and a shutter are provided. The shutter may be opened or closed as the rotational member rotates. The amounts of toner or carrier may be controlled according to the number the rotational member rotations. The toner and the carrier are sent to the developer supply passage 33, mixed therein as a developer, and supplied to the developing unit 4 through the supply port 11.

Figure 8:
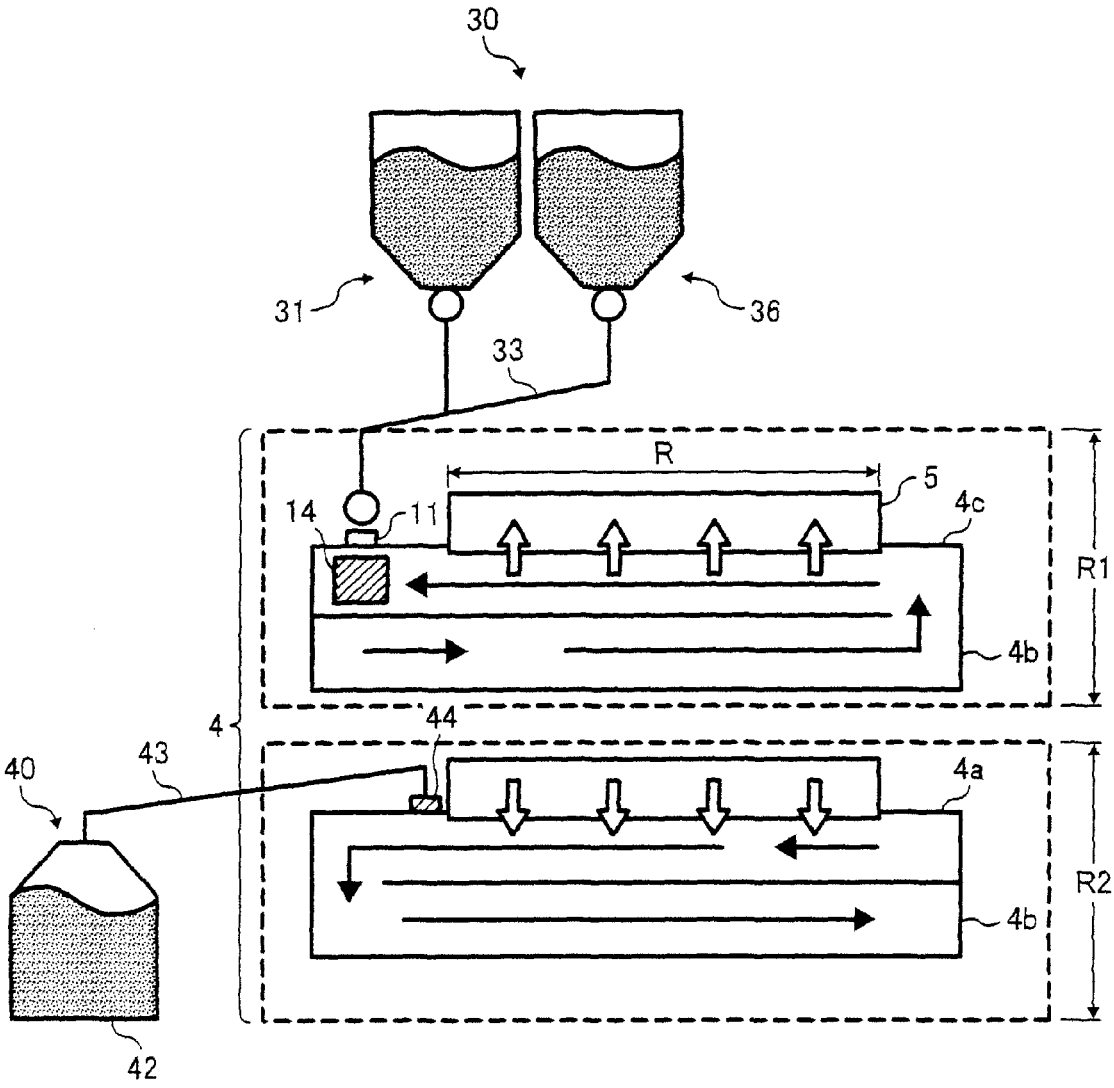
FIG. 8 is an illustration to explain circulation of the developer in the triaxial developing unit of FIG. 4A.

Next, flow of the developer in the developing unit 4 is described with reference to FIG. 8. In FIG. 8, the overhead views of the first part R1 and the second part R2 of the developing unit 4 are illustrated.

The developing unit 4 further includes a developer discharge unit 40 and a discharge port 44. The developer discharge unit 40 includes a developer container 42 and a discharge passage 43. The discharge port 44 is provided in the downstream part in the collecting part 4*a*.

Figure 6:
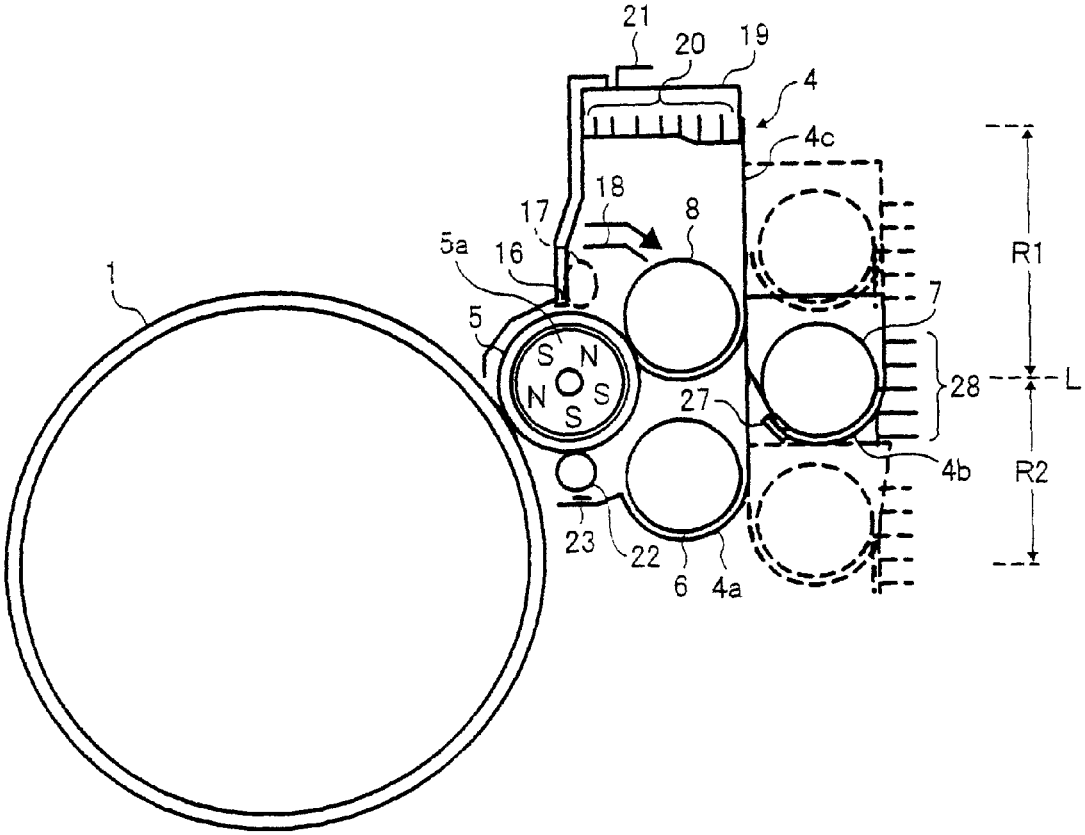
FIG. 6 is an illustration of the triaxial developing unit of FIG. 4A.

The developer is lifted from the supply part 4*c* to the developing roller 5 by a magnetic pole inside the magnet roller 5*a* (shown in FIG. 6). The developer is disengaged from the developing roller 5 due to the magnetism inside the magnet roller 5*a* and sent to the collecting part 4*a*, after passing the image forming region R. The amount of developer in the collecting part 4*a* progressively increases toward downstream. Excessive developer (used developer) is discharged through the discharge port 44 provided in the collecting part 4*a*. The developer that is not discharged is sent to the agitation part 4*b* at the downstream part of the collecting part 4*a*. Next, the developer is sent to the supply part 4*c* and is supplied to the developing roller 5. The amount of developer progressively decreases toward downstream. The developer that is not supplied to the developing roller 5 (unused developer) drops to the collecting part 4*a* from the supply part 4*c*, while mixed with an unused developer supplied through the supply port 11.

The used developer overflows from the discharge port 44 through the discharge passage 43 to the developer container 42. The discharge passage 43 may be a tube and include a spiral-shaped screw to transport the developer. Alternatively, the discharge passage 43 may be configured to transport the developer by gravity. The discharge port 44 may be provided on a side wall of the collecting part 4*c*. Alternatively, the discharge port 44 may include an openable and closable shutter at the bottom. The difference in size among the arrows indicates the difference in flow rates of developer. As the developer drops, agitation effect may be improved around the third opening 14. As the developer is supplied to a portion where agitation effect is significant, the supplied toner may be quickly mixed with the circulating developer in the developing unit 4.

It is desirable to substantially equalize the amount of developer discharged and the amount of the developer supplied. In the case of an overflow method, the amount of the developer may be automatically maintained constant in the entire developing unit 4. In the case of a discharge port with a shutter, the amount of developer may be maintained constant by controlling the time to open or to close the shutter.

The toner may be supplied according to toner consumption and the carrier may be supplied according to deterioration of the carrier. Thus, supply of the toner and the carrier may be separately controlled. Therefore, toner density in the developing unit 4 may be maintained constant.

The amount of developer may be maintained constant and image formation with less deteriorated developer may be performed by discharging the deteriorated developer and supplying the unused developer.

The unused developer is supplied above or near the third opening 14 where the developer is sent from the supply part 4*c* to the collecting part 4*a*. Therefore, the developer circulated in the supply part 4*c* and the unused developer may be sent to the collecting part 4*a* while being mixed together. As a result, agitation effect may be significantly improved. Further, the third opening 14 is far enough from the portion where the developer is supplied to the developing roller 5 so that the developer may be supplied to the developing roller 5 after charge quantity and toner density thereof are stabilized. Therefore, image density may be maintained stable.

The shape and rotation speed of the collecting screw 6, the supply screw 7, and the agitation screw 8 are determined to balance the flow rate of the developer in the developing unit 4. The flow rate of developer per unit time (kg/s) in the agitation part 4*b* may be set equal to a sum of the flow rates of developer per unit time at a lowermost portion in the supply part 4*c* and a lowermost portion in the collecting part 4*a*. An exemplary rotation speed of the screws is 600 rpm and sleeve linear speed of the developing roller 5 is 1000 mm per second.

As toner adhesion amount may be stabilized for a long time by using a developing unit according to an example embodiment, an image forming apparatus including the developing unit may produce a high quality image that excels in color reproducibility and/or color balance.

Productivity in producing color images with stable density may be significantly improved when a developing unit according to an exemplary embodiment is adopted in an image forming apparatus employing one-pass double sided printing. The image forming apparatus may produce color images having less quality difference on both sides of a sheet.

Figure 9A:
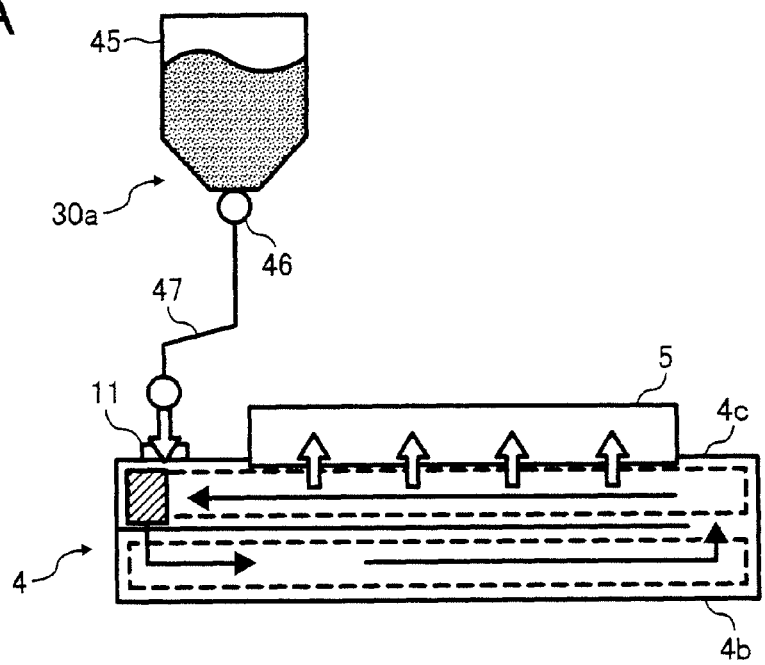
FIGS. 9A and 9B are illustrations to explain a developer supply unit to supply a premixed developer to the triaxial developing unit of FIG. 4A.
Figure 9B:
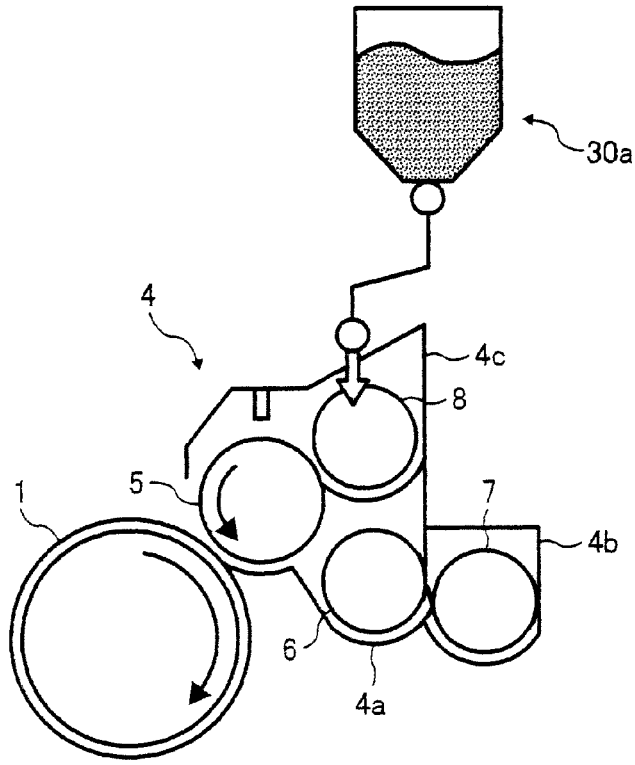

FIGS. 9A and 9B illustrate a developer supply unit 30*a* to supply a premixed developer. The developer supply unit 30*a* includes a developer container 45, a supply part 46, and a developer supply passage 47. The developer container 45 contains an unused premixed developer, that is, a mixture of toner and carrier. The developer is sent to the developer supply passage 47 and supplied to the developing unit 4 through the supply port 11. The supply part 46 controls the amount of developer to be supplied according to the signal sent by the density sensor 27 (as shown in FIG. 6). An example of supply part 46 may be a uniaxial eccentric screw pump (mono pump).

The unused premixed developer may include about 92 weight percent of carrier (toner:carrier=8:92). The weight percent of carrier in the developer may be determined according to conditions including the capacity of developing unit and/or container and the life of developer, not limited to the above value. Fewer containers are required to supply the developer when the premixed developer is used as above. Therefore, a developing unit may be downsized and the control of a developer supply may be simplified.

Figure 10A:
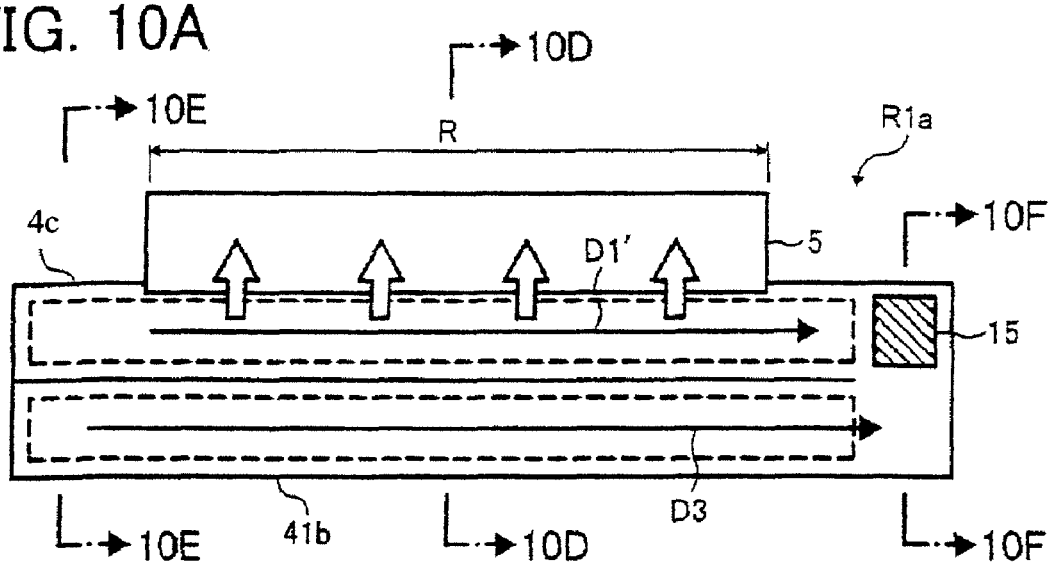
FIGS. 10A, 10B, and 10C are schematic diagrams illustrating horizontal cross sections of a four axis developing unit according to an exemplary embodiment of the present invention.
Figure 10B:
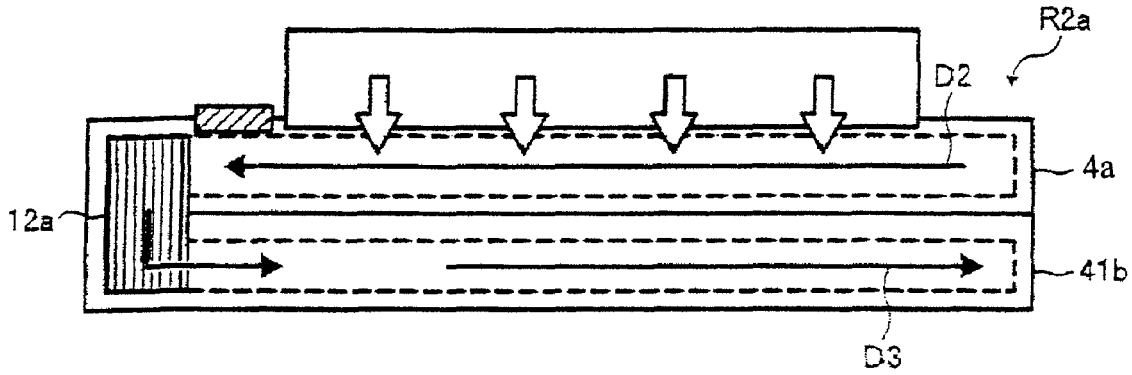
Figure 10C:
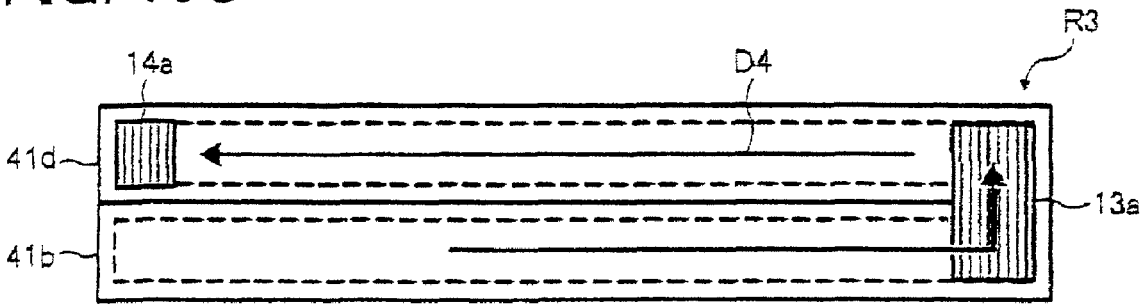
Figure 10D:
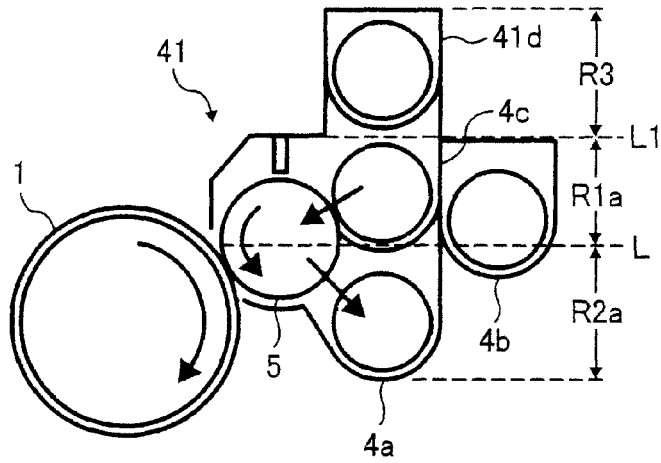
FIGS. 10D, 10E, and 10F are schematic diagrams illustrating vertical cross-sections of the four axis developing unit of FIG. 10A.
Figure 10E:
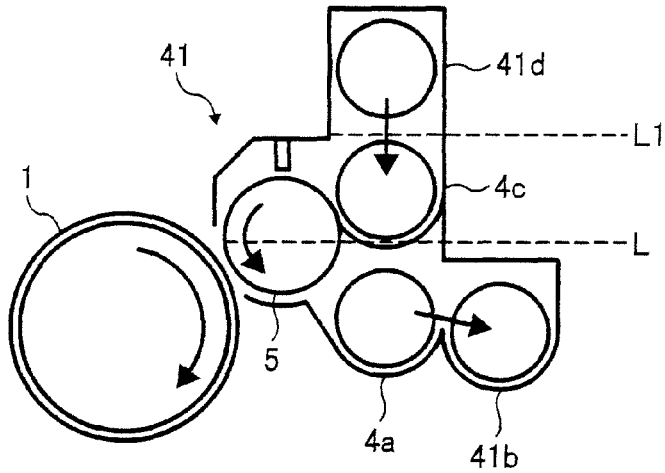
Figure 10F:
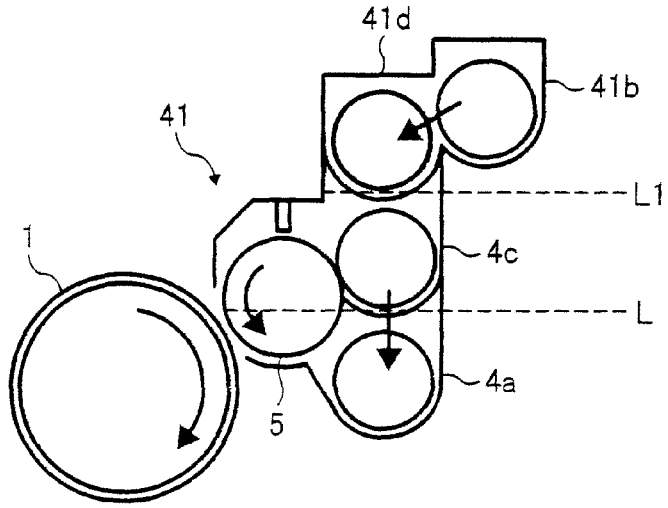

Next, a four axis developing unit 41 according to an example embodiment is described with reference to FIGS. 10A, 10B, 10C, 10D, 10E, and 10F. The developing unit 41 is divided into a first part R1*a*, a second part R2*a* and a third part R3 by horizontal lines L and L1 for illustrative purposes. FIGS. 10A, 10B, and 10C respectively illustrate a first part R1*a*, a second part R2*a* and a third part R3 viewed from above. FIGS. 10D, 10E, and 10F respectively illustrate vertically divided cross sections D-D, E-E, and F-F of the developing unit 41 and the photoconductor 1. The developing unit 41 includes a developing roller 5, a supply part 4*c*, a collecting part 4*a*, and an agitation part 41*b* similarly to the developing unit 4 illustrated in FIG. 6. The developing roller 5 is a developer carrier and has an image forming region R. The developing unit 41 further includes a transport part 41*d* the supply part 4*c*.

The developing unit 41 includes a first opening 12*a*, a second opening 13*a*, a third opening 14*a*, and a fourth opening 15 to circulate a developer in the developing unit 41. The first opening 12*a* connects a downstream part of the collecting part 4*a* and an upstream part of the agitation part 41*b*. The second opening 13*a* connects a downstream part of the agitation part 41*b* and an upstream part of the transport part 41*d*. The third opening 14*a* connects a downstream part of the transport part 41*d* and an upstream part of the supply part 4*c*. The fourth opening 15 connects a downstream part of the supply part 4*c* and an upstream part of the collecting part 4*a*.

The developer is transported in the direction shown by arrow D1' in the supply part 4*c*. The developer supplied to the developing roller 5 (used developer) is collected in the collecting part 4*a*. The developer that is not supplied to the developing roller 5 (unused developer) drops to the collecting part 4*a* through the fourth opening 15 to the upstream part of the collecting part 4*a*. The developer is transported in the direction shown by arrow D2 in the collecting part 4*a* and sent through the first opening 12*a* to the upstream part of the agitation part 41*b*. In the agitation part 41*b*, the developer is transported in the direction shown by arrow D3 and sent through the second opening 13*a* to the upstream part of the transport part 41*d*. In the transport part 41*d*, the developer is transported in the direction shown by arrow D4 and the developer is sent through the third opening 14*a* to the upstream part of the supply part 4*c*.

The fourth opening 15 is provided out of the image forming region R (non-image forming region) in a longitudinal direction of the supply part 4*c* to supply developer to the entire developing roller 5. The developer may be agitated for a longer time in the developing unit 41. Therefore, density and charge quantity of the developer may be improved.

Figure 11A:
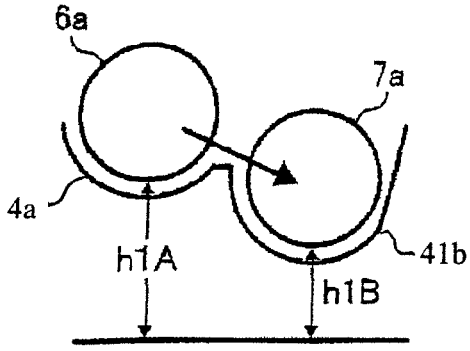
FIGS. 11A and 11B are illustrations to explain positional relations of a supply part, an agitation part, and a transport part included in the four axis developing unit of FIG. 10A.

FIG. 11A illustrates that a height of a bottom surface of the collecting part 4*a* and a height of a bottom surface of the agitation part 41*b* (upstream part) at the first opening 12*a* has a relation:

$$h1A>h1B$$

where h1A is the height of the bottom surface of the collecting part 4*a* and h1B is the height of the bottom surface of the agitation part 41*b*.

Figure 11B:
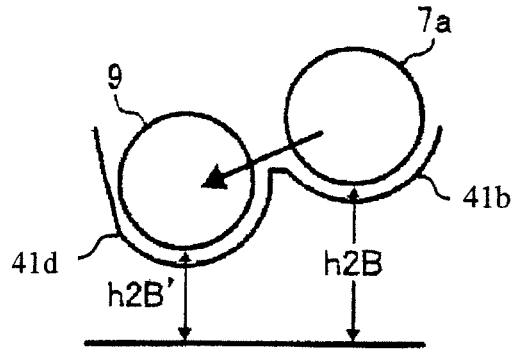

FIG. 11B illustrates that a height of a bottom surface of the agitation part 41*b* (downstream part) and a height of a bottom surface of the transport part 41*d* at the second opening 13*a* has a relation:

$$h2B>h2B'$$

where h2B is the height of the bottom surface of the agitation part 41*b* and h2B' is the height of the bottom surface of the transport part 41*d*.

The developer may flow down at the first opening 12*a* and the second opening 13*a*, and the transport efficiency may be improved by a gravitational effect.

The developing unit 41 is described in detail with reference to FIG. 12. Inside of the developing roller 5, a magnet roller 5*a* as a magnetic field generator is provided. The collecting part 4*a* includes a collecting screw 6*a*, the agitation part 41*b* includes an agitation screw 7*a*, the supply part 4*c* includes a supply screw 8*a*, and the transport part 41*d* includes a transport screw 9. The developing unit 41 further includes a developer regulator 16, a developer collector 18, a heat radiator 19, a capture roller 22, a scraper 23, a density sensor 27, and a fin 28. The heat radiator 19 includes a fin 20 and a guide 21. The developer regulator 16 includes an upstream part 17.

The shapes and rotation speeds of the collecting screw 6*a*, the supply screw 7*a*, the agitation screw 8*a*, and the transport screw 9 are determined to balance the flow rate of the developer in the developing unit 41. The flow rate of developer per unit time (kg/s) may be set equal in each of the agitation part 41*b*, the transport part 41*d*, an uppermost portion in the supply part 4*c*, and a lowermost portion in the collecting part 4*a*. In other respects, each part of the developing unit 41 has a similar configuration and function to a corresponding part of the developing unit 4 of FIG. 6.

Figure 13:
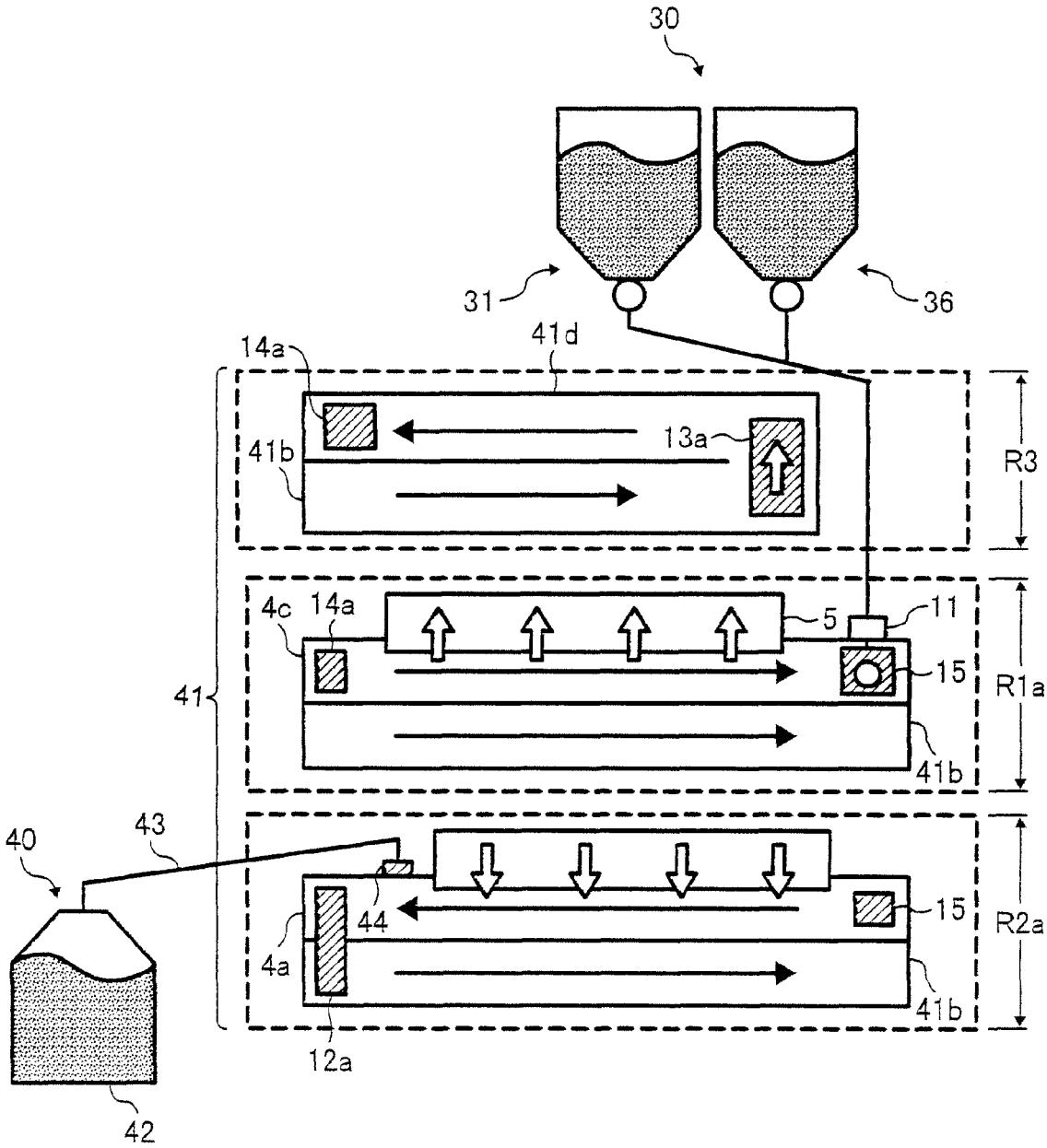
FIG. 13 is an illustration to explain circulation of the developer in the four axis developing unit of FIG. 10A.

Next, flow of the developer in the developing unit 41 is described with reference to FIG. 13. In FIG. 13, overhead views of the first part R1*a*, the second part R2*a*, and the third part R3 of the developing unit 41 divided by lines L and L1 are illustrated.

The developing unit 41 further includes a supply port 11, a developer supply unit 30, a developer discharge unit 40, and a discharge port 44. Each of the supply port 11, developer supply unit 30, developer discharge unit 40, and discharge port 44 has a similar configuration and function to the corresponding part of the developing unit 4 illustrated in FIG. 8. The supply port 11 may be provided above or near the fourth opening 15 in the supply part 4*c*. The discharge port 44 is provided in the downstream part in the collecting part 4*a*.

The developer is disengaged from the magnet roller 5*a* (not shown) due to the magnetism inside the developing roller 5 and sent to the collecting part 4*a*, after passing the image forming region R. The amount of developer in the collecting part 4*a* progressively increases toward downstream. Excessive developer (used developer) is discharged through the discharge port 44 provided in the collecting part 4*a*. The developer that is not discharged is sent to the agitation part 41*b* at the downstream part of the collecting part 4*a*.

The developer is sent to the transport part 41*d* at the downstream part of the agitation part 41*b*, unlike the developing unit 4 illustrated in FIG. 8. Then, developer is sent to the supply part 4*c* from the downstream part of the transport part 41*d*.

The developer is supplied from the supply part 4*c* to the developing roller 5 and the amount of developer progressively decreases toward downstream. The developer that is not supplied to the developing roller 5 (unused developer) drops from the supply part 4*c* to the collecting part 4*a* through the fourth opening 15, while mixed with an unused developer supplied through the supply port 11. The used developer overflows from the discharge port 44 through the discharge passage 43 to the developer container 42.

Next, characteristics of a carrier included in a developer according to an example embodiment are described in detail. The carrier desirably has a volume average particle size within a range of 20 μm to 60 μm. When the volume average particle size is equal to or less than 60 μm, the amount of developer lifted from a supply part to a developing roller may be reduced and the flow rate circulated in a developing unit may be reduced without deteriorating developing power. The developer may have a longer life because the amount of developer that passes a developer regulator, where the developer is stressed, may be reduced. Further the volume of carrier may be reduced and components associated with carrier storage may be downsized. Further, a magnetic brush in the image forming region may become finer, which may enhance quality and stability of an image.

If the volume average particle size is over 60 μm, the developer may tend to overflow in the circulation in the developing unit and the circulation of developer may become unstable. If the volume average particle size is under 20 μm, the carrier may easily adhere to a photoconductor or splash from the developing unit. The average particle size of carrier may be measured by a particle size analyzer, Microtrac SRA manufactured by PARTICLE NIKKISO CO., LTD., for example. A measured range may be set to a range of 0.7 μm to 125 μm.

Next, characteristics of a toner included in a developer according to an example embodiment are described in detail. The toner desirably has a volume average particle size (d4) within a range of 3 μm to 8 μm. As space among toner particles may be reduced by using a toner having a small particle size and a sharp particle size distribution, the amount of toner to be adhered may be reduced without deteriorating color reproducibility. Therefore, density fluctuation caused in a developing process may be reduced. Further, reproducibility of a fine image having a resolution of 600 dpi or more may become more stable.

When the volume average particle size of toner is under 3 μm, problems including deterioration in transfer efficiency and blade cleaning may occur. When the volume average particle size of toner is over 8 μm, pile height of an image is increased and the toner may be scattered from a character and/or line. The value of the volume average particle size (d4) divided by a number average particle size (d1), d4/d1, is desirably within a range of 1.00 to 1.40. The closer the value of d4/d1 is to 1.00, the sharper the particle size distribution becomes. When the toner having a small particle size and a sharp particle size distribution is used, charge distribution of toner may be equalized. Therefore, fog in images may be reduced and transfer efficiency on an electrostatic transfer method may be improved.

The particle size distribution of the toner may be measured by a method based on the Coulter principle. The measurement may be executed by using a Coulter Counter TA II or Coulter Multisizer II (trade name) manufactured by Beckman Coulter, Inc.

An electrolyte solution, 1 percent NaCl solution, is prepared by using primary sodium chloride. ISOTON-II manufactured by Beckman Coulter, Inc. is available as a ready-made electrolyte solution. As a dispersant, 0.1 ml to 5 ml of surfactant is added to 100 ml to 150 ml of electrolyte solution. Alkyl benzene sulfonate is desirable as surfactant. Next, 2 ml to 20 ml of toner particles are added and suspended in the electrolyte solution. The electrolyte solution is further dispersed by an ultrasonic disperser for 1 to 3 minutes. The volume and the number of the toner particles are measured and volume distribution and number distribution thereof are calculated by either of the above measuring instruments with an aperture of 100 μm. The number average particle size (d1) and the volume average particle size (d4) may be obtained based on the above distribution.

The number of channels used in the measurement is thirteen. The ranges of the channels are greater than or equal to 2.00 μm and less than 2.52 μm, greater than or equal to 2.52 μm to less than 3.17 μm, greater than or equal to 3.17 μm and less than 4.00 μm, greater than or equal to 4.00 μm and less than 5.04 μm, greater than or equal to 5.04 μm and less than 6.35 μm, greater than or equal to 6.35 μm and less than 8.00 μm, greater than or equal to 8.00 μm and less than 10.08 μm, greater than or equal to 10.08 μm and less than 12.70 μm, greater than or equal to 12.70 μm and less than 16.00 μm, greater than or equal to 16.00 μm and less than 20.20 μm, greater than or equal to 20.20 μm and less than 25.40 μm, greater than or equal to 25.40 μm and less than 32.00 μm, greater than or equal to 32.00 μm and less than 40.30 μm. The range to be measured is set greater than or equal to 2.00 μm and less than 40.30 μm.

Figure 14:
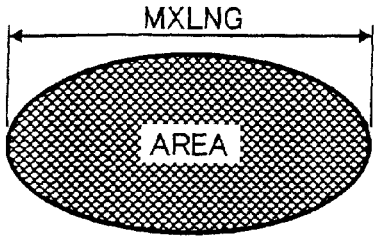
FIG. 14 is an illustration of a toner particle to explain a first shape factor SF1.
Figure 15:
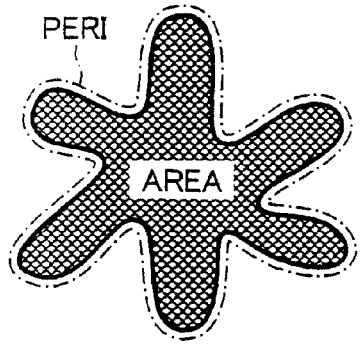
FIG. 15 is an illustration of a toner particle to explain a second shape factor SF2.

The toner desirably has a first shape factor SF1 and a second shape factor SF2 both within a range of 100 to 180. The first shape factor SF1 and the second shape factor SF2 are explained with reference to FIGS. 14 and 15. The first shape factor SF1 shows a degree of roundness and is expressed by formula 1;

$$SF1=\{(MXLNG)^2\div\mathrm{AREA}\}\times(100\pi\div4)$$

wherein MXLGN is a maximum length of toner particle projected on a two-dimensional surface and AREA is an area of toner particle.

The toner particle is a sphere when the first shape factor SF1 is 100. The larger the SF1 becomes, the more the toner particle becomes amorphous.

The second shape factor SF2 shows a degree of irregularity and is expressed by formula 2;

$$SF2=\{(PERI)^2 \div \mathrm{AREA}\} \times (100 \div 4\pi)$$

wherein PERI is a peripheral length of toner particle projected on a two-dimensional surface and AREA is the area of the toner particle.

The toner particle is flat when the first shape factor SF1 is 100. The larger the first shape factor SF1 becomes, the more the toner particle has irregularities.

The first shape factor SF1 and second shape factor SF2 were measured based on a photograph taken by a scanning electron microscope, S-800 (Hitachi, Ltd.) in an exemplary embodiment. The photograph was analyzed by an image analyzer, LUSEX3 manufactured by NIKON CORPORATION. The contact areas among toner particles are small when toner particles are subglobular. Therefore, absorption power among toner particles is weak and fluidity is high. As a result, circularity of the developer may be improved. Further, contact areas of the toner particles with a photoconductor are small and absorption power of the toner particles to the photoconductor is weak. As a result, transfer efficiency and image quality may be improved. On the other hand, when either or both of the first shape factor SF1 and second shape factor SF2 exceed 180, fluidity and circularity of the developer and transfer efficiency may be deteriorated.

On the surfaces of the toner particle used in an exemplary embodiment, fine particles having an average primary particle size (hereinafter referred to as average particle size) within a range of 50 nm to 500 nm and powder density greater than or equal to 0.3 mg/cm$^3$ are attached (hereinafter referred to as fine particles). For example, silica is a typical fluidity improver and has an average particle size within a range of 10 nm to 30 nm and powder density within a range of 0.1 mg/cm$^3$ to 0.2 mg/cm$^3$.

Appropriate space may exist between the toner particle and an object because the fine particle having proper characteristics is attached to the surface of the toner particle. Further, the fine particle has significant effect to reduce adherence of the toner because the contact areas of the fine particle to the toner particle, the photoconductor, and a charger are small. Because the fluidity of the toner may be improved, stresses to the developer may be reduced.

Further, the burden to the photoconductor may be reduced because the fine particle functions as a roller. Even when the fine particles are highly stressed with high load and/or high speed by the cleaning blade and/or the photoconductor during clearing, the fine particles are not likely to sink in the toner particles. Even if the fine particles sink in the toner particles, the fine particles may be released and recovered. Therefore, the fine particles may maintain their characteristics for a long time. Further, the fine particles may moderately disengage from the toner particles and accumulate on a tip of the cleaning blade, which may prevent the toner particles from passing the cleaning blade due to a dam effect. The above characteristics may be effective to reduce filming of toner due to a low rheology component contained in the toner. The low rheology component is added to the toner for high speed fixing (e.g. low energy fixing). Cleaning may be effectively performed when the average particle size of fine particles is within the range of 50 nm to 500 nm. Further, powder fluidity of toner may not be reduced. Although details are not known, a developer may be less deteriorated when fine particles are added to toner particles included in the developer, even when the carrier is contaminated. Therefore, the fluidity and electrostatic property of toner may change less over time.

The average particle size of fine particles used in an embodiment is desirably within the range of 50 nm to 500 nm. A fine particle whose average particle size is within a range of 100 nm to 400 nm is more desirable. When average particle size of the fine particles is less than 50 nm, the fine particles may sink in concave portions of toner particles and may not function properly as rollers. When the average particle size of fine particles is over 500 nm, toner particles to be removed may pass between the cleaning blade and the photoconductor when the fine particles are situated between the cleaning blade and the photoconductor. Therefore, a defect in cleaning may occur.

When powder density of fine particles is less than 0.3 mg/cm$^3$, the toner and the fine particles are more easily scattered and the adhesion of the toner and the fine particles increases, although the fluidity may be improved. Therefore, the roller effect of the fine particles may be reduced. Further, the dam effect, which is given by the fine particles accumulated at the tip of the cleaning blade, may be reduced.

The fine particle used in an exemplary embodiment may include at least one inorganic compound or one organic compound. Preferable examples of inorganic compounds are $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)n$, $Al_2O_3.2SiO_2$, $CaCO_3$, $MgCO_3$, $BaSO_4$, $MgSO_4$, and $SrTiO_3$. Among the above, $SiO_2$, $TiO_2$, and $Al_2O_3$ are more desirable. The above inorganic compound may be hydrophobized with a coupling agent including hexamethyldisilazane, dimethyldichlorosilane, and octyltrimethoxysilane.

Either of a thermoplastic resin and a thermosetting resin may be used as the organic compound. Preferable examples of the organic compound are vinyl resins, polyurethane resins, epoxy resins, polyester resins, polyamide resins, polyimide resins, silicon resins, phenol resins, melamine resins, urea resins, aniline resins, ionomer resins, and polycarbonate resins. Two or more of the above resins may be concurrently used as the fine particles. Desirable organic compounds are vinyl resins, polyurethane resins, epoxy resins, polyester resins, and concurrent use of these resins because water dispersions of fine spherical resin particles are easily available.

Examples of vinyl resins may be polymers produced by homopolymerizing a vinyl monomer or copolymerizing vinyl monomers. Such polymers include styrene-(metha)acrylic ester copolymers, styrene-butadiene copolymers, styrene-maleic anhydride copolymers, styrene-(metha)acrylic acid copolymers.

In an exemplary embodiment, powder density of fine particles was measured by the following method. A graduated cylinder of 100 ml was filled with 100 ml of the fine particles bit by bit. While the fine particles were put in the graduated cylinder, no vibration was given to the graduated cylinder. The graduated cylinder was weighted before and after being filled with the fine particles. Thus, the weight of fine particles in the graduated cylinder of 100 ml was measured. The powder density (PD) was calculated based on the weight of the graduated cylinder, G, by the formula below:

$$PD(\mathrm{g/cm^3})=G(\mathrm{g/100\ ml}) \div 100$$

Examples of the method to attach the fine particles to the surfaces of toner particles are described below. In one example method, toner particles (mother particles) and fine particles are mechanically mixed in a publicly known mixer. In another example method, toner particles (mother particles) and fine particles are uniformly dispersed in a liquid with a surfactant. After the fine particles are attached to the surfaces of the toner particles, they are dried.

Figure 16:
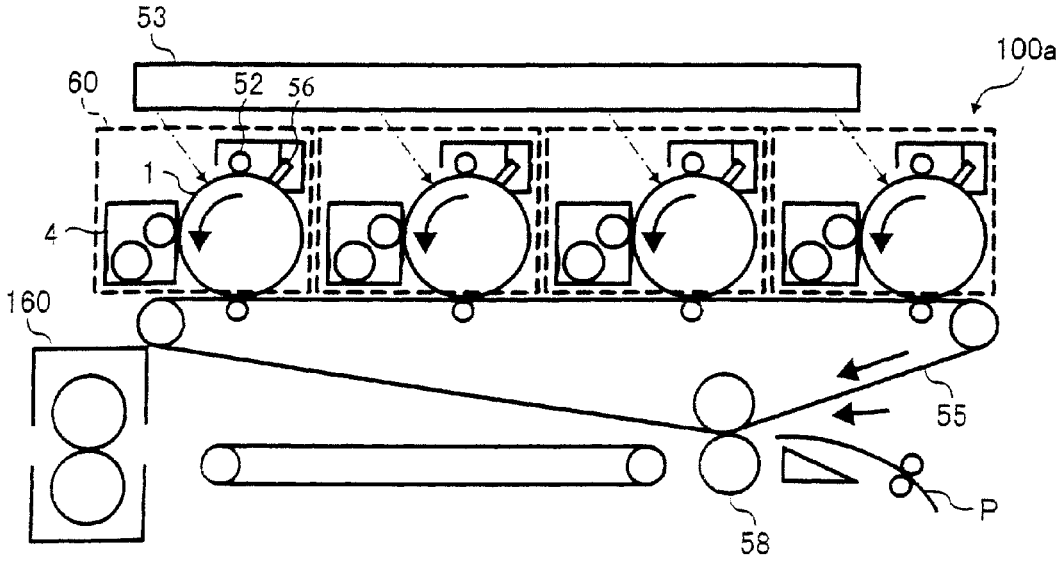
FIG. 16 is an illustration of another image forming apparatus according to an exemplary embodiment of the present invention.

FIG. 16 illustrates a major part of an image forming apparatus 100*a* according to another exemplary embodiment. The image forming apparatus 100*a* is a tandem image forming apparatus and forms an image on only a first side (front side) of a sheet P at a time, and is different from the image forming apparatus 100 illustrated in FIG. 2.

The image forming apparatus 100*a* includes an exposure device 53, an intermediate transfer belt 55, a secondary transfer device 58, a fixing unit 160, a sheet transporting unit (not shown), and four process cartridges 60 for yellow, cyan, magenta, and black. The process cartridges 60 are arranged in line on the intermediate transfer belt 55. Each of the process cartridges 60 includes a photoconductor 1 and a charging device 52, a developing unit 4, and a cleaning device 56 around the photoconductor 1.

Two or more components selected from a group including the photoconductor 1, the charging device 52, the developing unit 4, and the cleaning device 56 are united in each of the process cartridges 60 that is detachably attached to the image forming apparatus 100*a*. In other respects, each part of the image forming apparatus 100*a* has a similar configuration and a function to the corresponding part of the image forming apparatus 100.

Next, comparative examples are described.

COMPARATIVE EXAMPLE 1

A biaxial developing unit was installed in the image forming apparatus 100 illustrated in FIG. 2 and 1000 g of developer was initially supplied. Images were formed on recording sheets while a toner and a carrier were independently exchanged. After about 250 thousand recording sheets were printed, image density was decreased in a durability evaluation.

COMPARATIVE EXAMPLE 2

The unidirectional developing unit (triaxial developing unit) illustrated in FIG. 1 was installed in the image forming apparatus 100 illustrated in FIG. 2 and 1000 g of developer was initially supplied. Images were formed on recording sheets while a toner and a carrier were independently exchanged. After about 350 thousand recording sheets were printed, image density was decreased in a durability evaluation.

EXAMPLE 1

The triaxial developing unit 4 illustrated in FIG. 6 was installed in the image forming apparatus 100 illustrated in FIG. 2 and 1000 g of a developer was initially supplied. Images were formed on recording sheets while a toner and a carrier were independently exchanged. After about 600 thousand recording sheets were printed, image density was decreased in a durability evaluation. It was proven that the life of developer was significantly prolonged and image density was maintained constant for a longer time, compared to comparative examples 1 and 2.

EXAMPLE 2

Figure 12:
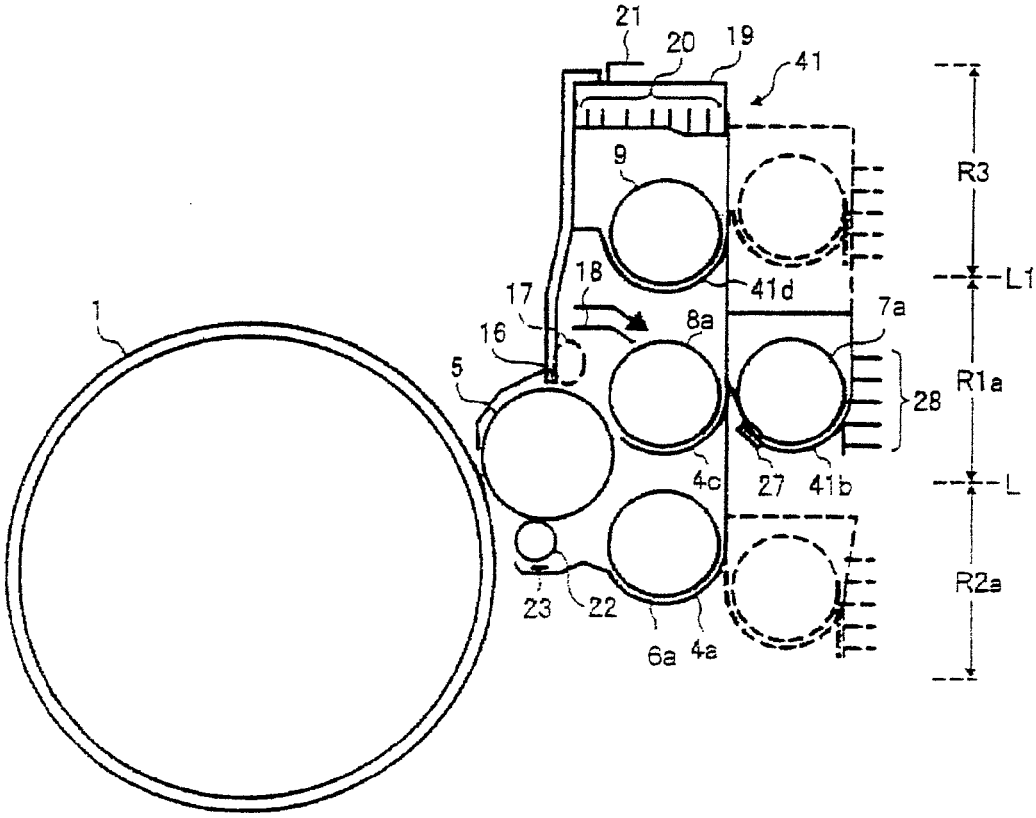
FIG. 12 is an illustration of the four axis developing unit of FIG. 10A.

The four axis developing unit 41 illustrated in FIG. 12 was installed in the image forming apparatus 100 illustrated in FIG. 2 and 1000 g of developer was initially supplied. Images were formed on recording sheets while a toner and a carrier were independently exchanged. After about 600 thousand recording sheets were printed, image density was decreased in a durability evaluation. It was proven that the life of developer was significantly prolonged and image density was maintained constant for a longer time, compared to comparative examples 1 and 2.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JP2005-339755 filed on Nov. 25, 2005 and No. JP2006-266514 filed on Sep. 29, 2006 in the Japan Patent Office, the entire contents of each of which are hereby incorporated by reference herein.

What is claimed is:

1. A developing unit to circulate a developer unidirectionally, comprising:

a developer carrier provided at a position facing an image carrier;

a magnetic field generator provided inside the developer carrier;

a supply part housing a supply screw configured to supply a developer to the developer carrier along a rotation axis of the developer carrier;

a collecting part provided under the supply part and housing a collecting screw;

an agitation part provided at a side of the supply part and the collecting part and housing an agitation screw including an upstream part and a downstream part;

a first opening penetrating the collecting part and the agitation part configured to transport the developer from a downstream part of the collecting screw to the upstream part of the agitation screw in a developer circulation;

a second opening penetrating the agitation part and the supply part configured to transport the developer from the downstream part of the agitation screw to an upstream part of the supply screw; and a third opening penetrating the supply part and the collecting part configured to transport the developer from a downstream part of the supply screw to the downstream part of the collecting screw, wherein an unused developer is supplied via a supply port located above the third opening through which the developer is transported from the supply screw to the collecting screw, and wherein a height of a bottom surface of the downstream part of the agitation screw is higher than a height of a bottom surface of the supply screw such that the developer flows downward through the second opening.

2. The developing unit according to claim 1, wherein a height of a bottom surface of the collecting screw is higher than a height of a bottom surface of the upstream part of the agitation screw such that the developer flows downward through the first opening.

3. The developing unit according to claim 1, wherein a quantity per unit time of the developer transported by the agitation screw is substantially equal to a sum of quantities per unit time of the developer transported at a most downstream part of the collecting screw and the developer transported at a most downstream part of the supply screw.

4. The developing unit according to claim 1, wherein the third opening is provided at a non-image forming region of a long side of the supply part.

5. The developing unit according to claim 1, further comprising:

a developer supply unit configured to feed an unused premix developer; and a developer discharge unit configured to discharge the developer from the developing unit to an outside of the developing unit.

6. The developing unit according to claim 1, further comprising:

a developer supply unit configured to independently control carrier supply and toner supply and to include a carrier supply part configured to supply an unused carrier, and a toner supply part configured to supply an unused toner.

7. The developing unit according to claim 1, wherein the developer comprises:

a carrier having a volume average particle size within a range of 20 μm to 60 μm.

8. The developing unit according to claim 1, wherein the developer comprises:

a toner having a volume average particle size within a range of 3 μm to 8 μm, wherein a ratio of the volume average particle size of the toner to a number average particle size is within a range of 1.00 to 1.40.

9. The developing unit according to claim 1, wherein the developer comprises:

a toner having a first shape factor within a range of 100 to 180 and a second shape factor within a range of 100 to 180.

10. The developing unit according to claim 1, wherein the developer comprises:

a toner including a fine particle added to a surface of a toner particle and having an average primary particle size within a range of 50 nm to 500 nm and a powder density equal to or greater than 0.3 g/cm$^3$.

11. A color image forming apparatus, comprising:

a plurality of image carriers to form an electrostatic latent image thereon; and a plurality of developing units according to claim 1.

12. The color image forming apparatus according to claim 11, further comprising:

a first image station to form a first toner image to be transferred on a first side (front side) of the recording sheet, including a group of first image forming units, each including at least one of the plurality of developing units and one of the plurality of image carriers for each color, and a first image carrying belt on which the first toner image is transferred; and a second image station configured to form a second toner image transferred on a second side (back side) of the recording sheet, including a group of second image forming units, each including at least one of the plurality of developing units and one of the plurality of image carriers for each color, and a second image carrying belt on which the second toner image is transferred, wherein the first and second toner images are simultaneously or sequentially transferred onto the recording sheet in a one-pass double sided printing method before a fixing process.

13. A developing unit to circulate a developer unidirectionally, comprising:

a developer carrier provided at a position facing an image carrier;

a magnetic field generator provided inside the developer carrier;

a supply part housing a supply screw configured to supply a developer to the developer carrier in a rotation axis direction of the developer carrier;

a collecting part provided under the supply part and housing a collecting screw;

an agitation part provided at a side of the supply part and the collecting part and housing an agitation screw including an upstream part and a downstream part;

a transport part housing a transport screw and arranged at a side of the agitation part and completely above the supply part;

a first opening penetrating the collecting part and the agitation part configured to transport the developer from a downstream part of the collecting screw to the upstream part of the agitation screw in a developer circulation;

a second opening penetrating the agitation part and the transport part configured to transport the developer from a downstream part of the agitation screw to an upstream part of the transport screw;

a third opening penetrating the transport part and the supply part configured to transport the developer from a downstream part of the transport screw to an upstream part of the supply screw; and a fourth opening penetrating the supply part and the collecting part configured to transport the developer from a downstream part of the supply screw to an upstream part of the collecting screw.

14. The developing unit according to claim 13, wherein a height of a bottom surface of the collecting screw is higher than a height of a bottom surface of the upstream part of the agitation screw such that the developer flows downward through the first opening.

15. The developing unit according to claim 13, wherein quantities per unit time of the developer transported by the agitation screw, the developer transported by the transport screw, the developer transported at a most upstream part of the supply screw, and the developer transported at a most downstream part of the collecting screw are substantially equal.

16. The developing unit according to claim 13, wherein the fourth opening is provided at a non-image forming region of a long side of the supply part.

17. The developing unit according to claim 13, wherein the supply screw, the collecting screw, and the transport screw overlap in a vertical direction, and the agitation screw does not overlap the supply screw, the collecting screw, and the transport screw in the vertical direction.

18. The developing unit according to claim 13, wherein a height of a bottom surface of the downstream part of the agitation screw is higher than a height of a bottom surface of the transport screw such that the developer flows downward through the second opening.

19. The developing unit according to claim 13, further comprising a supply port through which unused developer is supplied to the developing unit, provided in the supply part, wherein the supply port is disposed above the fourth opening.

* * * * *